US009767720B2

(12) United States Patent
Kinnebrew et al.

(10) Patent No.: US 9,767,720 B2
(45) Date of Patent: Sep. 19, 2017

(54) OBJECT-CENTRIC MIXED REALITY SPACE

(75) Inventors: Peter Tobias Kinnebrew, Seattle, WA (US); Nicholas Ferianc Kamuda, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 275 days.

(21) Appl. No.: 13/532,636

(22) Filed: Jun. 25, 2012

(65) Prior Publication Data

US 2013/0342570 A1 Dec. 26, 2013

(51) Int. Cl.
*G09G 5/00* (2006.01)
*G09G 3/00* (2006.01)

(52) U.S. Cl.
CPC ..... *G09G 3/003* (2013.01); *G09G 2340/12* (2013.01); *G09G 2340/125* (2013.01)

(58) Field of Classification Search
None
See application file for complete search history.

(56) References Cited

U.S. PATENT DOCUMENTS 5,710,894 A * 1/1998 Maulsby et al. ..... 715/763
5,712,964 A * 1/1998 Kamada ..... G09G 1/16 345/418
6,529,183 B1 * 3/2003 MacLean et al. ..... 345/156
6,629,065 B1 * 9/2003 Gadh ..... G06T 17/10 345/420
6,756,984 B1 * 6/2004 Miyagawa ..... A63F 13/10 345/473
6,968,077 B1 * 11/2005 Yamanaka ..... G06T 1/00 382/128
8,717,360 B2 * 5/2014 Vesely et al. ..... 345/427
8,953,889 B1 * 2/2015 Worley, III ..... G06F 17/30489 382/103
8,990,682 B1 * 3/2015 Wong ..... G02B 27/017 715/254
2002/0033839 A1 3/2002 Elber et al.
2002/0033845 A1 * 3/2002 Elber ..... G06T 17/00 715/764
2002/0095523 A1 * 7/2002 Shimakawa et al. ..... 709/316
2003/0009754 A1 * 1/2003 Rowley ..... G06F 8/61 717/177
2003/0140058 A1 * 7/2003 Martin ..... G06F 17/30569
2004/0233201 A1 * 11/2004 Calkins et al. ..... 345/473
2005/0128212 A1 * 6/2005 Edecker et al. ..... 345/582
(Continued)

OTHER PUBLICATIONS

Diverdi, et al., "Envisor: Online Environment Map Construction for Mixed Reality", In Proceedings of IEEE Virtual Conference, Mar. 8, 2008, pp. 19-26.

(Continued)

*Primary Examiner* — Anh-Tuan V Nguyen
(74) *Attorney, Agent, or Firm* — Vierra Magen Marcus LLP

(57) ABSTRACT

A see-through, near-eye, mixed reality display apparatus providing a mixed reality environment wherein one or more virtual objects and one or more real objects exist within the view of the device. Each of the real and virtual have a commonly defined set of attributes understood by the mixed reality system allowing the system to manage relationships and interaction between virtual objects and other virtual objects, and virtual and real objects.

19 Claims, 21 Drawing Sheets

(56) References Cited

U.S. PATENT DOCUMENTS

2006/0048092 A1 3/2006 Kirkley et al.
2006/0118634 A1* 6/2006 Blythe et al. ..... 235/462.15
2007/0208577 A1* 9/2007 Leon ..... G06Q 10/00 705/71
2008/0015418 A1* 1/2008 Jarrell et al. ..... 600/300
2008/0024597 A1 1/2008 Yang et al.
2008/0094417 A1 4/2008 Cohen
2009/0099824 A1* 4/2009 Falash et al. ..... 703/8
2009/0249290 A1* 10/2009 Jenkins ..... G06F 9/4443 717/109
2009/0262107 A1* 10/2009 Castelli et al. ..... 345/419
2010/0103196 A1 4/2010 Kumar et al.
2010/0168876 A1* 7/2010 Nakano ..... G05B 17/02 700/31
2010/0185529 A1* 7/2010 Chesnut et al. ..... 705/27
2010/0208033 A1* 8/2010 Edge et al. ..... 348/46
2010/0238161 A1* 9/2010 Varga et al. ..... 345/419
2010/0253700 A1* 10/2010 Bergeron ..... 345/633
2010/0287500 A1 11/2010 Whitlow et al.
2010/0309197 A1* 12/2010 Porwal ..... 345/419
2011/0084983 A1* 4/2011 Demaine ..... 345/633
2011/0110557 A1* 5/2011 Clark et al. ..... 382/103
2011/0213664 A1 9/2011 Osterhout et al.
2011/0214082 A1 9/2011 Osterhout et al.
2011/0221793 A1 9/2011 King, III et al.
2011/0242134 A1* 10/2011 Miller et al. ..... 345/633
2011/0249122 A1* 10/2011 Tricoukes et al. ..... 348/158
2011/0316845 A1 12/2011 Roberts et al.
2012/0075168 A1 3/2012 Osterhout et al.
2012/0142415 A1* 6/2012 Lindsay ..... 463/33
2012/0162254 A1* 6/2012 Anderson et al. ..... 345/633
2012/0188256 A1* 7/2012 Lee et al. ..... 345/473
2012/0210255 A1* 8/2012 Ooi et al. ..... 715/762
2012/0250940 A1* 10/2012 Kasahara ..... 382/103
2013/0038510 A1 2/2013 Brin et al.
2013/0044042 A1 2/2013 Olsson et al.
2013/0265502 A1* 10/2013 Huebner ..... 348/789
2013/0290876 A1* 10/2013 Anderson et al. ..... 715/761
2013/0307875 A1* 11/2013 Anderson ..... 345/633
2013/0335301 A1 12/2013 Wong et al.

OTHER PUBLICATIONS

Walairacht, et al., "4+4 Fingers Manipulating Virtual Objects in Mixed-Reality Environment", In Journal of Presence: Teleoperators and Virtual Environments—Mixed Reality, vol. 11, Issue 2, Apr. 2002, pp. 134-143.

Vallino, et al., "Augmenting Reality Using Affine Object Representations" Published on: May 1, 2006, Available at: http://www.se.rit.edu/~jrv/publications/Vallino-ARWC.pdf.

* cited by examiner

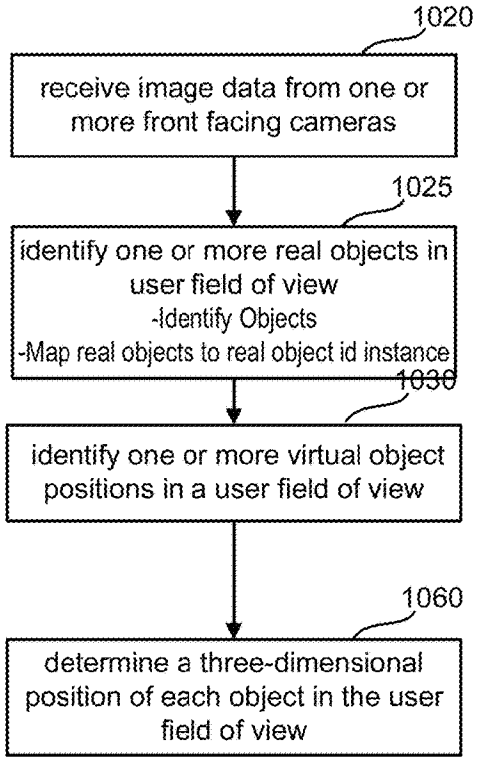
FIG. 10A
FIG. 9
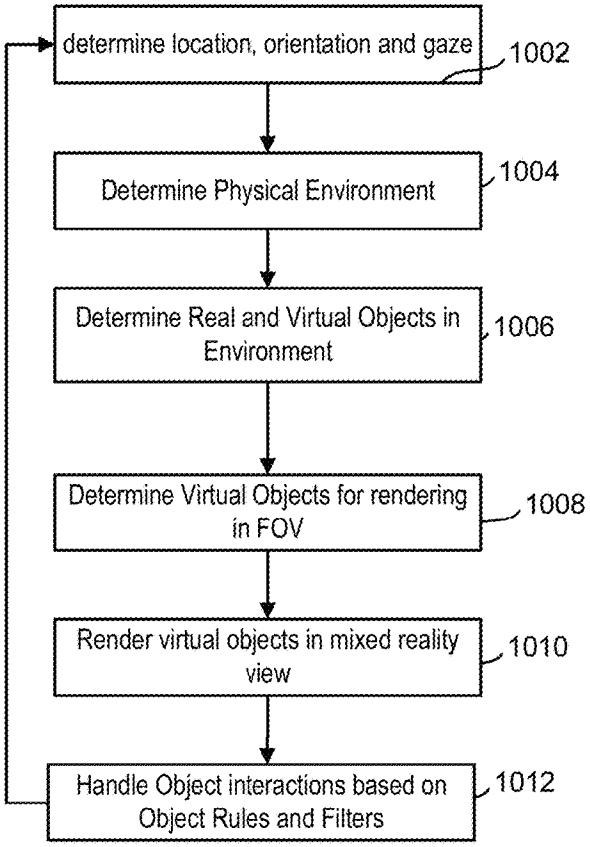

OBJECT-CENTRIC MIXED REALITY SPACE

BACKGROUND

Mixed reality is a technology that allows virtual imagery to be mixed with a real world physical environment. In a mixed reality system using, for example, smart phones with built in cameras, virtual images are superimposed onto real world environments using positioning data in the phones. However, superimposing images in this manner does not require reconciling the superimposed image with the real world environment or other images. In many cases, these mixed reality systems do not present a view of interaction of the virtual elements and the real world beyond the virtual images presented.

SUMMARY

Technology is described herein which provides various embodiments for implementing a mixed reality environment using a see-through, mixed reality display device. The mixed reality environment has one or more virtual objects and one or more real objects which exist within the view of the device. Each of the real and virtual have a commonly defined set of attributes that are understood by the mixed reality system allowing the system to manage relationships and interaction between virtual objects and other virtual objects, and virtual and real objects. A common object definition with a common set of attributes is used to create individual instances of both real and virtual objects.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 9 is a flowchart illustrating a method of providing a mixed reality environment in a see through head mounted mixed reality display.

FIG. 10A is a flowchart illustrating a step in FIG. 9 of determining real and virtual objects in an environment.

DETAILED DESCRIPTION

The technology described herein includes a see-through, mixed reality display device providing a mixed reality environment wherein one or more virtual objects and one or more real objects exist within the view of the device. Each of the real and virtual have a commonly defined set of attributes that are understood by the mixed reality system allowing the system to manage relationships and interaction between virtual objects and other virtual objects, and virtual and real objects.

A common object definition with a common set of attributes is used to create individual instances of both real and virtual objects. An object identifier identifies object structures, which may be non-unique, statistically unique, or unique to the object definition. Instances of objects are created by the display system and may also be specifically identified and may be non-unique, statistically unique, or unique. Each object structure and object instance is associated with a person, object or environment, and can be accessed in physical space by reference to spatial coordinates. The attributes of the object contain properties used to generate and maintain virtual objects in the real world environment, and provide functions to the virtual objects. A system filter allows interpretation of object interactions which may conflict with user preferences for the user of the system.

Figure 1A:
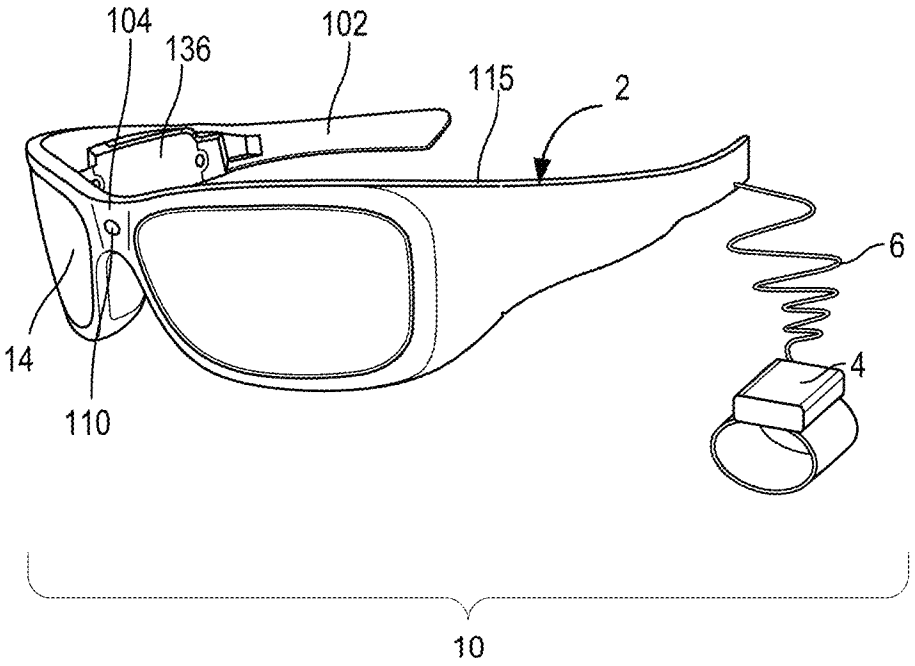
FIG. 1A is a block diagram depicting example components of one embodiment of a see-through, mixed reality display device with adjustable IPD in a system environment in which the device may operate.

FIG. 1A is a block diagram depicting example components of one embodiment of a see-through, mixed reality display device in a system environment in which the device may operate. In one embodiment, the technology implements a see through, near-eye display device. In other embodiments, see through display devices of different types may be used. System 10 includes a see-through display device as a near-eye, head mounted display device 2 in communication with processing unit 4 via wire 6. In other embodiments, head mounted display device 2 communicates with processing unit 4 via wireless communication. Processing unit 4 may take various embodiments. In some embodiments, processing unit 4 is a separate unit which may be worn on the user's body, e.g. the wrist in the illustrated example or in a pocket, and includes much of the computing power used to operate near-eye display device 2. Processing unit 4 may communicate wirelessly (e.g., WiFi, Bluetooth, infra-red, or other wireless communication means) to one or more computing systems, hot spots, cellular data networks, etc. In other embodiments, the functionality of the processing unit 4 may be integrated in software and hardware components of the display device 2.

See through head mounted display device 2, which in one embodiment is in the shape of eyeglasses in a frame 115, is worn on the head of a user so that the user can see through a display, embodied in this example as a display optical system 14 for each eye, and thereby have an actual direct view of the space in front of the user. The use of the term "actual direct view" refers to the ability to see real world objects directly with the human eye, rather than seeing created image representations of the objects. For example, looking through glass at a room allows a user to have an actual direct view of the room, while viewing a video of a room on a television is not an actual direct view of the room. Based on the context of executing software, for example, a gaming application, the system can project images of virtual objects, sometimes referred to as virtual images or holograms, on the display that are viewable by the person wearing the see-through display device while that person is also viewing real world objects through the display.

Frame 115 provides a support for holding elements of the system in place as well as a conduit for electrical connections. In this embodiment, frame 115 provides a convenient eyeglass frame as support for the elements of the system discussed further below. In other embodiments, other support structures can be used. An example of such a structure is a visor, hat, helmet or goggles. The frame 115 includes a temple or side arm for resting on each of a user's ears. Temple 102 is representative of an embodiment of the right temple and includes control circuitry 136 for the display device 2. Nose bridge 104 of the frame includes a microphone 110 for recording sounds and transmitting audio data to processing unit 4.

Figure 1B:
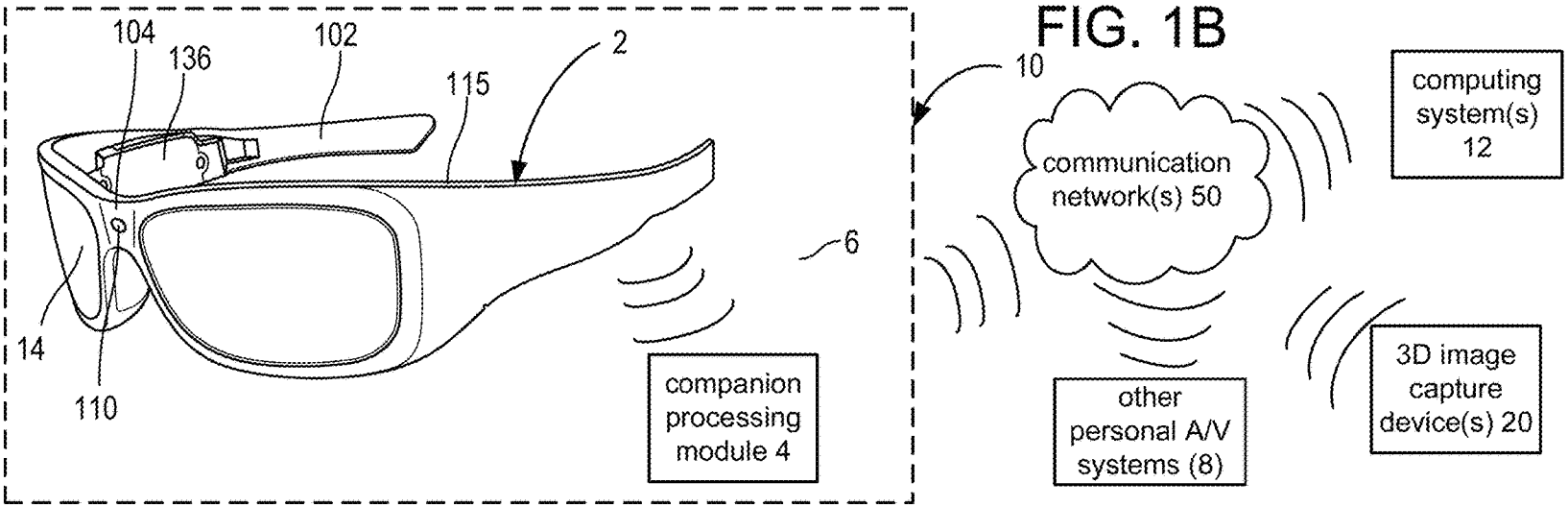
FIG. 1B is a block diagram depicting example components of another embodiment of a see-through, mixed reality display device with adjustable IPD.

FIG. 1B is a block diagram depicting example components of another embodiment of a see-through, mixed reality display device. In some embodiments, processing unit 4 is a separate unit which may be worn on the user's body, e.g. a wrist, or be a separate device like a mobile device (e.g. smartphone). The processing unit 4 may communicate wired or wirelessly (e.g., WiFi, Bluetooth, infrared, RFID transmission, wireless Universal Serial Bus (USB), cellular, 3G, 4G or other wireless communication means) over a communication network 50 to one or more computing systems 12 whether located nearby or at a remote location. In other embodiments, the functionality of the processing unit 4 may be integrated in software and hardware components of the display device 2.

One or more remote, network accessible computer system (s) 12 may be leveraged for processing power and remote data access. An example of hardware components of a computing system 12 is shown in FIG. 16. An application may be executing on computing system 12 which interacts with or performs processing for an application executing on one or more processors in the see-through, augmented reality display system 10. For example, a 3D mapping application may be executing on the one or more computer systems 12 and the user's display system 10.

Additionally, in some embodiments, the applications executing on other see through head mounted display systems 10 in same environment or in communication with each other share data updates in real time, for example object identifications and occlusion data like an occlusion volume for a real object, in a peer-to-peer configuration between devices or to object management service executing in one or more network accessible computing systems.

The shared data in some examples may be referenced with respect to one or more referenced coordinate systems accessible to the device 2. In other examples, one head mounted display (HMD) device may receive data from another HMD device including image data or data derived from image data, position data for the sending HMD, e.g. GPS or IR data giving a relative position, and orientation data. An example of data shared between the HMDs is depth map data including image data and depth data captured by its front facing cameras 113, object identification data, and occlusion volumes for real objects in the depth map. The real objects may still be unidentified or have been recognized by software executing on the HMD device or a supporting computer system, e.g. 12 or another display system 10.

An example of an environment is a 360 degree visible portion of a real location in which the user is situated. A user may be looking at a subset of his environment which is his field of view. For example, a room is an environment. A person may be in a house and be in the kitchen looking at the top shelf of the refrigerator. The top shelf of the refrigerator is within his display field of view, the kitchen is his environment, but his upstairs bedroom is not part of his current environment as walls and a ceiling block his view of the upstairs bedroom. Of course, as he moves, his environment changes. Some other examples of an environment may be a ball field, a street location, a section of a store, a customer section of a coffee shop and the like. A location can include multiple environments, for example, the house may be a location. The user and his friends may be wearing their display device systems for playing a game which takes place throughout the house. As each player moves about the house, his environment changes. Similarly, a perimeter around several blocks may be a location and different intersections provide different environments to view as different cross streets come into view. In some instances, a location can also be an environment depending on the precision of location tracking sensors or data.

Figure 2A:
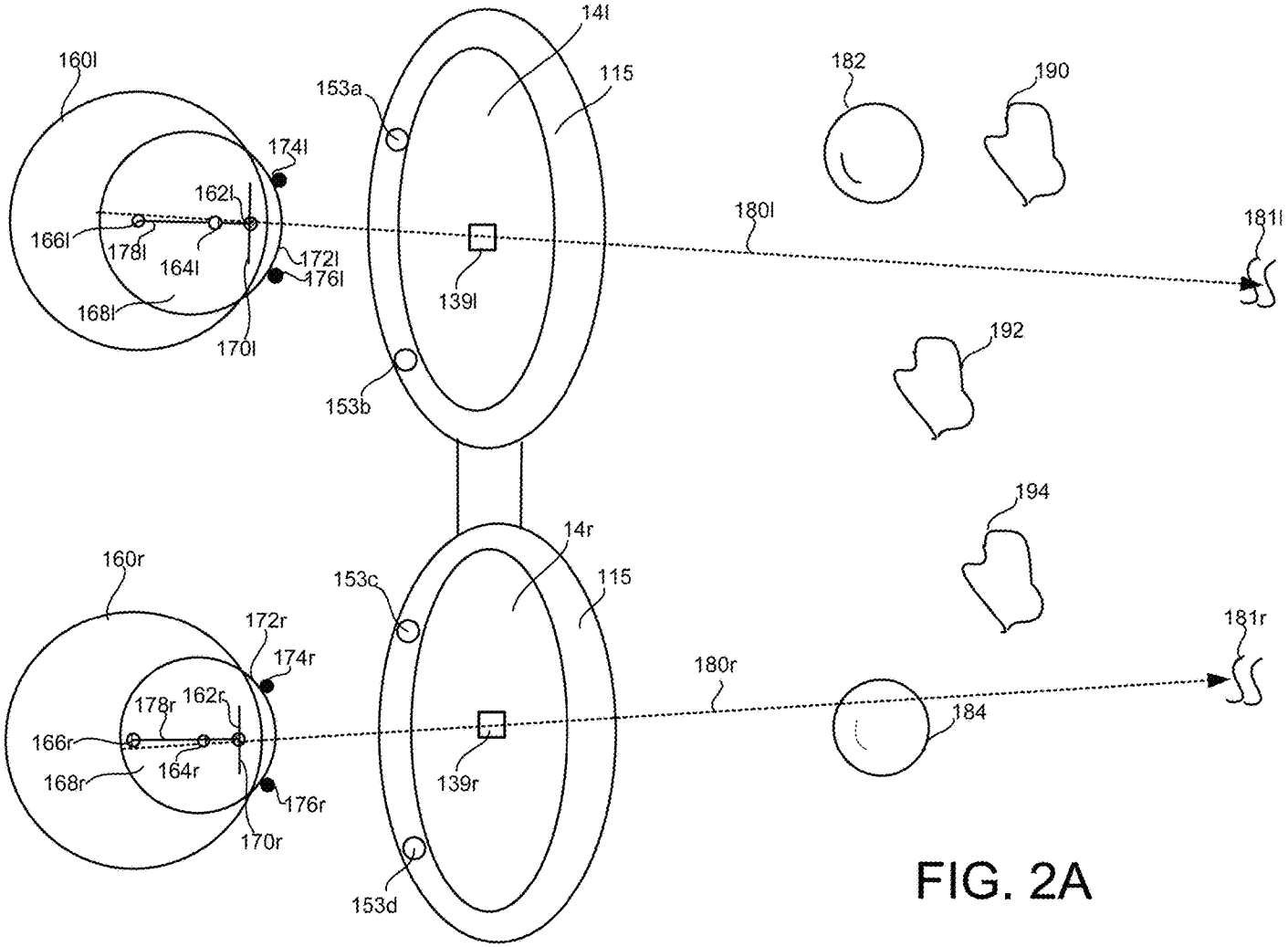
FIG. 2A is a top view illustrating examples of gaze vectors extending to a point of gaze at a distance and a direction for aligning a far IPD.

FIG. 2A is a top view illustrating examples of gaze vectors extending to a point of gaze at a distance and direction for aligning a far inter-pupillary distance (IPD). FIG. 2A illustrates examples of gaze vectors intersecting at a point of gaze where a user's eyes are focused effectively at infinity, for example beyond five (5) feet, or, in other words, examples of gaze vectors when the user is looking straight ahead. A model of the eyeball 160*l*, 160*r* is illustrated for each eye based on the Gullstrand schematic eye model. For each eye, an eyeball 160 is modeled as a sphere with a center 166 of rotation and includes a cornea 168 modeled as a sphere too and having a center 164. The cornea rotates with the eyeball, and the center 166 of rotation of the eyeball may be treated as a fixed point. The cornea covers an iris 170 with a pupil 162 at its center. In this example, on the surface 172 of the respective cornea are glints 174 and 176.

In the illustrated embodiment of FIG. 2A, a sensor detection area 139 (139*l* and 139*r*) is aligned with the optical axis of each display optical system 14 within an eyeglass frame 115. The sensor associated with the detection area is a camera in this example capable of capturing image data representing glints 174*l* and 176*l* generated respectively by illuminators 153*a* and 153*b* on the left side of the frame 115 and data representing glints 174*r* and 176*r* generated respectively by illuminators 153*c* and 153*d*. Through the display optical systems, 14*l* and 14*r* in the eyeglass frame 115, the user's field of view includes both real objects 190, 192 and 194 and virtual objects 182, 184, and 186.

The axis 178 formed from the center 166 of rotation through the cornea center 164 to the pupil 162 is the optical axis of the eye. A gaze vector 180 is sometimes referred to as the line of sight or visual axis which extends from the fovea through the center of the pupil 162. The fovea is a small area of about 1.2 degrees located in the retina. The angular offset between the optical axis computed and the visual axis has horizontal and vertical components. The horizontal component is up to 5 degrees from the optical axis, and the vertical component is between 2 and 3 degrees. In many embodiments, the optical axis is determined and a small correction is determined through user calibration to obtain the visual axis which is selected as the gaze vector.

For each user, a virtual object may be displayed by the display device at each of a number of predetermined positions at different horizontal and vertical positions. An optical axis may be computed for each eye during display of the object at each position, and a ray modeled as extending from the position into the user eye. A gaze offset angle with horizontal and vertical components may be determined based on how the optical axis is to be moved to align with the modeled ray. From the different positions, an average gaze offset angle with horizontal or vertical components can be selected as the small correction to be applied to each computed optical axis. In some embodiments, a horizontal component is used for the gaze offset angle correction.

The gaze vectors 180*l* and 180*r* are not perfectly parallel as the vectors become closer together as they extend from the eyeball into the field of view at a point of gaze which is effectively at infinity as indicated by the symbols 181*l* and 181*r*. At each display optical system 14, the gaze vector 180 appears to intersect the optical axis upon which the sensor detection area 139 is centered. In this configuration, the optical axes are aligned with the inter-pupillary distance (IPD). When a user is looking straight ahead, the IPD measured is also referred to as the far IPD.

When identifying an object for a user to focus on for aligning IPD at a distance, the object may be aligned in a direction along each optical axis of each display optical system. Initially, the alignment between the optical axis and user's pupil is not known. For a far IPD, the direction may be straight ahead through the optical axis. When aligning near IPD, the identified object may be in a direction through the optical axis, however due to vergence of the eyes at close distances, the direction is not straight ahead although it may be centered between the optical axes of the display optical systems.

Figure 2B:
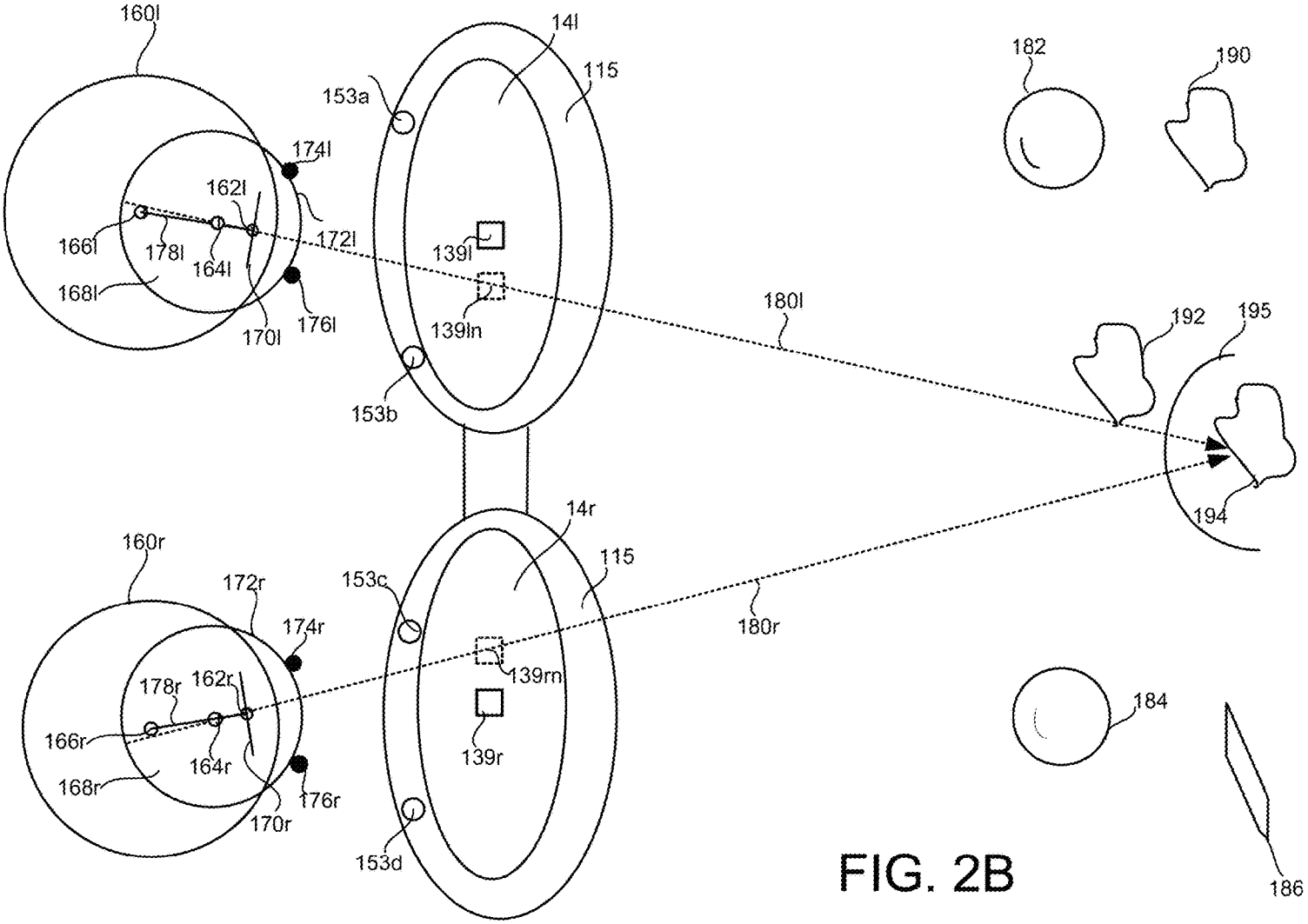
FIG. 2B is a top view illustrating examples of gaze vectors extending to a point of gaze at a distance and a direction for aligning a near IPD.

FIG. 2B is a top view illustrating examples of gaze vectors extending to a point of gaze at a distance and a direction for aligning a near IPD. In this example, the cornea 1681 of the left eye is rotated to the right or towards the user's nose, and the cornea 168*r* of the right eye is rotated to the left or towards the user's nose. Both pupils are gazing at a real object 194 at a much closer distance, for example two (2) feet in front of the user. Gaze vectors 180*l* and 180*r* from each eye enter the Panum's fusional region 195 in which real object 194 is located. The Panum's fusional region is the area of single vision in a binocular viewing system like that of human vision. The intersection of the gaze vectors 180*l* and 180*r* indicates that the user is looking at real object 194. At such a distance, as the eyeballs rotate inward, the distance between their pupils decreases to a near IPD. The near IPD is typically about 4 mm less than the far IPD. A near IPD distance criteria, e.g. a point of gaze at less than four feet for example, may be used to switch or adjust the IPD alignment of the display optical systems 14 to that of the near IPD. For the near IPD, each display optical system 14 may be moved toward the user's nose so the optical axis, and detection area 139, moves toward the nose a few millimeters as represented by detection areas 139*ln* and 139*rn*.

Techniques for automatically determining a user's IPD and automatically adjusting the STHMD to set the IPD for optimal user viewing, are discussed in co-pending U.S. patent application Ser. No. 13/221,739 entitled "Gaze Detection In A See-Through, Near-Eye, Mixed Reality Display"; U.S. patent application Ser. No. 13/221,707 entitled "Adjustment Of A Mixed Reality Display For Inter-Pupillary Distance Alignment"; and U.S. patent application Ser. No. 13/221,662 entitled "Aligning Inter-Pupillary Distance In A Near-Eye Display System", all of which are hereby incorporated specifically by reference.

Figure 3A:
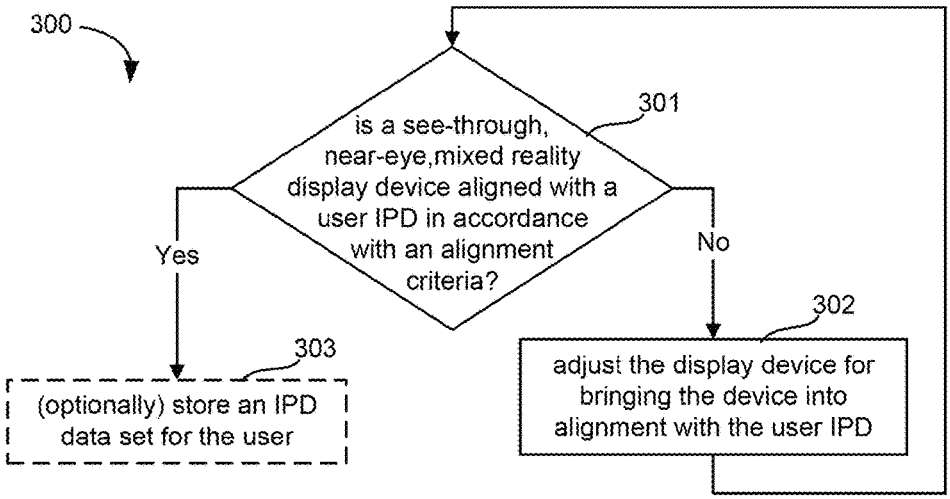
FIG. 3A is a flowchart of a method embodiment for aligning a see-through, near-eye, mixed reality display with an IPD.

In general, FIG. 3A shows is a flowchart of a method embodiment 300 for aligning a see-through, near-eye, mixed reality display with an IPD. In step 301, one or more processors of the control circuitry 136, automatically determines whether a see-through, near-eye, mixed reality display device is aligned with an IPD of a user in accordance with an alignment criteria. If not, in step 302, the one or more processors cause adjustment of the display device by at least one display adjustment mechanism for bringing the device into alignment with the user IPD. If it is determined the see-through, near-eye, mixed reality display device is in alignment with a user IPD, optionally, in step 303 an IPD data set is stored for the user. In some embodiments, a display device 2 may automatically determine whether there is IPD alignment every time anyone puts on the display device 2. However, as IPD data is generally fixed for adults, due to the confines of the human skull, an IPD data set may be determined typically once and stored for each user. The stored IPD data set may at least be used as an initial setting for a display device with which to begin an IPD alignment check.

Figure 3B:
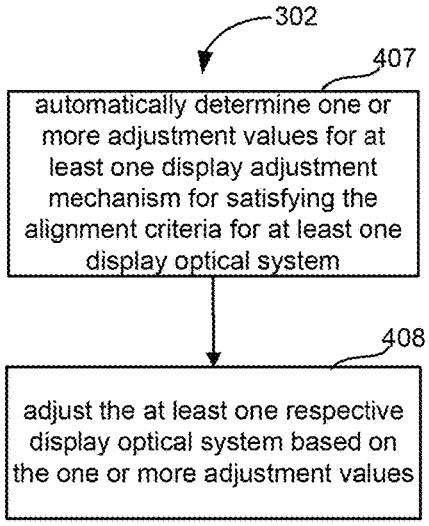
FIG. 3B is a flowchart of an implementation example of a method for adjusting a display device for bringing the device into alignment with a user IPD.

FIG. 3B is a flowchart of an implementation example of a method for adjusting a display device for bringing the device into alignment with a user IPD. In this method, at least one display adjustment mechanism adjusts the position of a at least one display optical system 14 which is misaligned. In step 407, one or more adjustment are automatically determined for the at least one display adjustment mechanism for satisfying the alignment criteria for at least one display optical system. In step 408, that at least one display optical system is adjusted based on the one or more adjustment values. The adjustment may be performed automatically under the control of a processor or mechanically as discussed further below.

Figure 3C:
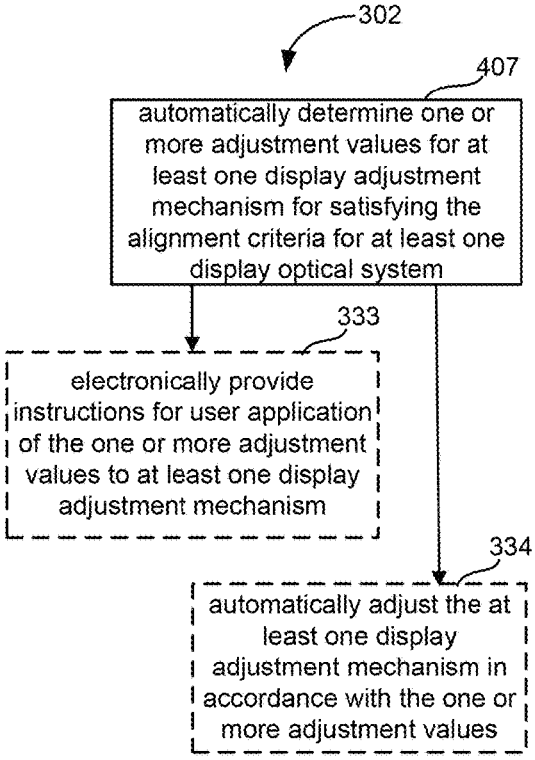
FIG. 3C is a flowchart illustrating different example options of mechanical or automatic adjustment of at least one display adjustment mechanism.

FIG. 3C is a flowchart illustrating different example options of mechanical or automatic adjustment by the at least one display adjustment mechanism as may be used to implement step 408. Depending on the configuration of the display adjustment mechanism in the display device 2, from step 407 in which the one or more adjustment values were already determined, the display adjustment mechanism may either automatically, meaning under the control of a processor, adjust the at least one display adjustment mechanism in accordance with the one or more adjustment values in step 334. Alternatively, one or more processors associated with the system may electronically provide instructions as per step 333 for user application of the one or more adjustment values to the at least one display adjustment mechanism. There may be instances of a combination of automatic and mechanical adjustment under instructions.

Some examples of electronically provided instructions are instructions displayed by the microdisplay 120, the processing unit 4 or audio instructions through speakers 130 of the display device 2. There may be device configurations with an automatic adjustment and a mechanical mechanism depending on user preference or for allowing a user some additional control.

Figure 4A:
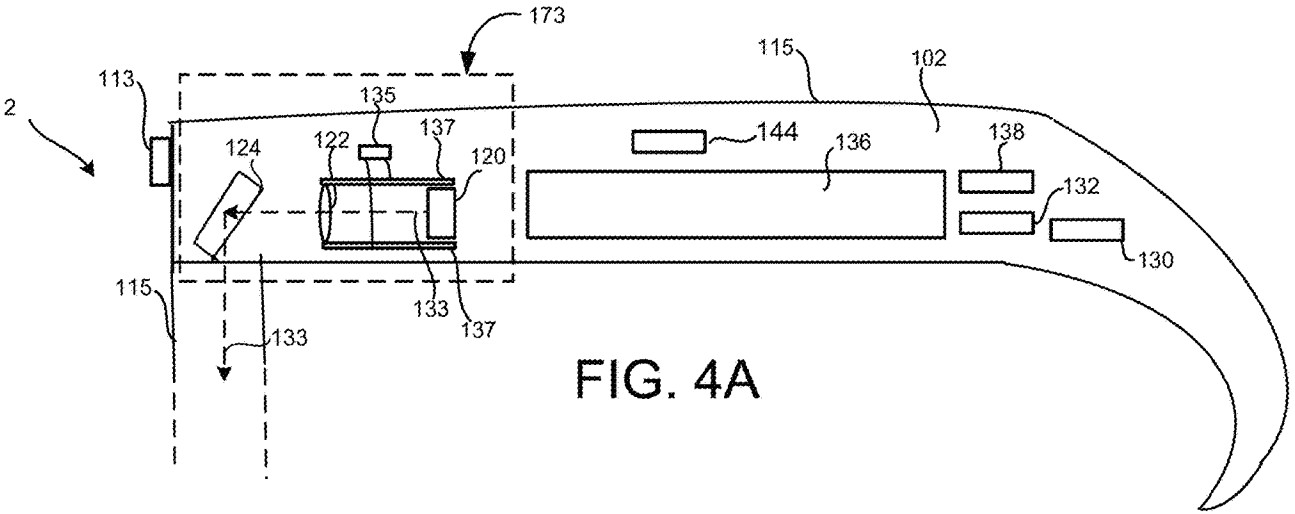
FIG. 4A is a side view of an eyeglass temple in an eyeglasses embodiment of a mixed reality display device providing support for hardware and software components.

FIG. 4A illustrates an exemplary arrangement of a see through, near-eye, mixed reality display device embodied as eyeglasses with movable display optical systems including gaze detection elements. What appears as a lens for each eye represents a display optical system 14 for each eye, e.g. 14*r* and 14*l*. A display optical system includes a see-through lens, e.g. 118 and 116 in FIGS. 5A-5*b*, as in an ordinary pair of glasses, but also contains optical elements (e.g. mirrors, filters) for seamlessly fusing virtual content with the actual direct real world view seen through the lenses 118, 116. A display optical system 14 has an optical axis which is generally in the center of the see-through lens 118, 116 in which light is generally collimated to provide a distortionless view. For example, when an eye care professional fits an ordinary pair of eyeglasses to a user's face, a goal is that the glasses sit on the user's nose at a position where each pupil is aligned with the center or optical axis of the respective lens resulting in generally collimated light reaching the user's eye for a clear or distortionless view.

In an exemplary display device 2, a detection area of at least one sensor is aligned with the optical axis of its respective display optical system so that the center of the detection area is capturing light along the optical axis. If the display optical system is aligned with the user's pupil, each detection area of the respective sensor is aligned with the user's pupil. Reflected light of the detection area is transferred via one or more optical elements to the actual image sensor of the camera in this example illustrated by dashed line as being inside the frame 115.

In one example, a visible light camera (also commonly referred to as an RGB camera) may be the sensor. An example of an optical element or light directing element is a visible light reflecting mirror which is partially transmissive and partially reflective. The visible light camera provides image data of the pupil of the user's eye, while IR photodetectors 152 capture glints which are reflections in the IR portion of the spectrum. If a visible light camera is used, reflections of virtual images may appear in the eye data captured by the camera. An image filtering technique may be used to remove the virtual image reflections if desired. An IR camera is not sensitive to the virtual image reflections on the eye.

In other examples, the at least one sensor is an IR camera or a position sensitive detector (PSD) to which the IR radiation may be directed. For example, a hot reflecting surface may transmit visible light but reflect IR radiation. The IR radiation reflected from the eye may be from incident radiation of illuminators, other IR illuminators (not shown) or from ambient IR radiation reflected off the eye. In some examples, sensor may be a combination of an RGB and an IR camera, and the light directing elements may include a visible light reflecting or diverting element and an IR radiation reflecting or diverting element. In some examples, a camera may be small, e.g. 2 millimeters (mm) by 2 mm.

Various types of gaze detection systems are suitable for use in the present system. In some embodiments which calculate a cornea center as part of determining a gaze vector, two glints, and therefore two illuminators will suffice. However, other embodiments may use additional glints in determining a pupil position and hence a gaze vector. As eye data representing the glints is repeatedly captured, for example at 30 frames a second or greater, data for one glint may be blocked by an eyelid or even an eyelash, but data may be gathered by a glint generated by another illuminator.

FIG. 4A is a side view of an eyeglass temple 102 of the frame 115 in an eyeglasses embodiment of a see-through, mixed reality display device. At the front of frame 115 is physical environment facing video camera 113 that can capture video and still images. Particularly in some embodiments, physical environment facing camera 113 may be a depth camera as well as a visible light or RGB camera. For example, the depth camera may include an IR illuminator transmitter and a hot reflecting surface like a hot mirror in front of the visible image sensor which lets the visible light pass and directs reflected IR radiation within a wavelength range or about a predetermined wavelength transmitted by the illuminator to a CCD or other type of depth sensor. Other types of visible light camera (RGB camera) and depth cameras can be used. More information about depth cameras can be found in U.S. patent application Ser. No. 12/813,675, filed on Jun. 11, 2010, entitled "MULTI-MODAL GENDER RECOGNITION" incorporated herein by reference in its entirety. The data from the sensors may be sent to a processor 210 of the control circuitry 136, or the processing unit 4 or both which may process them but which the unit 4 may also send to a computer system over a network or secondary computing system for processing. The processing identifies objects through image segmentation and edge detection techniques and maps depth to the objects in the user's real world field of view. Additionally, the physical environment facing camera 113 may also include a light meter for measuring ambient light.

Control circuitry 136 provide various electronics that support the other components of head mounted display device 2. More details of control circuitry 136 are provided below with respect to FIGS. 6A and 6B. Inside, or mounted to temple 102, are ear phones 130, inertial sensors 132, GPS transceiver 144 and temperature sensor 138. In one embodiment inertial sensors 132 include a three axis magnetometer 132A, three axis gyro 132B and three axis accelerometer 132C (See FIG. 7A). The inertial sensors are for sensing position, orientation, and sudden accelerations of head mounted display device 2. From these movements, head position may also be determined.

The display device 2 provides an image generation unit which can create one or more images including one or more virtual objects. In some embodiments a microdisplay may be used as the image generation unit. A microdisplay assembly 173 in this example comprises light processing elements and a variable focus adjuster 135. An example of a light processing element is a microdisplay 120. Other examples include one or more optical elements such as one or more lenses of a lens system 122 and one or more reflecting elements such as reflective elements 124*a* and 124*b* in FIGS. 6A and 6B or 124 in FIGS. 6C and 6D. Lens system 122 may comprise a single lens or a plurality of lenses.

Mounted to or inside temple 102, the microdisplay 120 includes an image source and generates an image of a virtual object. The microdisplay 120 is optically aligned with the lens system 122 and the reflecting element 124 or reflecting elements 124*a* and 124*b* as illustrated in the following Figures. The optical alignment may be along an optical path 133 including one or more optical axes. The microdisplay 120 projects the image of the virtual object through lens system 122, which may direct the image light, onto reflecting element 124 which directs the light into lightguide optical element 112 as in FIGS. 5C and 5D or onto reflecting element 124*a* (e.g. a mirror or other surface) which directs the light of the virtual image to a partially reflecting element 124*b* which combines the virtual image view along path 133 with the natural or actual direct view along the optical axis 142 as in FIGS. 5A-5D. The combination of views are directed into a user's eye.

The variable focus adjuster 135 changes the displacement between one or more light processing elements in the optical path of the microdisplay assembly or an optical power of an element in the microdisplay assembly. The optical power of a lens is defined as the reciprocal of its focal length, e.g. 1/focal length, so a change in one effects the other. The change in focal length results in a change in the region of the field of view, e.g. a region at a certain distance, which is in focus for an image generated by the microdisplay assembly 173.

In one example of the microdisplay assembly 173 making displacement changes, the displacement changes are guided within an armature 137 supporting at least one light processing element such as the lens system 122 and the microdisplay 120 in this example. The armature 137 helps stabilize the alignment along the optical path 133 during physical movement of the elements to achieve a selected displacement or optical power. In some examples, the adjuster 135 may move one or more optical elements such as a lens in lens system 122 within the armature 137. In other examples, the armature may have grooves or space in the area around a light processing element so it slides over the element, for example, microdisplay 120, without moving the light processing element. Another element in the armature such as the lens system 122 is attached so that the system 122 or a lens within slides or moves with the moving armature 137. The displacement range is typically on the order of a few millimeters (mm). In one example, the range is 1-2 mm. In other examples, the armature 137 may provide support to the lens system 122 for focal adjustment techniques involving adjustment of other physical parameters than displacement. An example of such a parameter is polarization.

For more information on adjusting a focal distance of a microdisplay assembly, see U.S. patent Ser. No. 12/941,825 entitled "Automatic Variable Virtual Focus for Augmented Reality Displays," filed Nov. 8, 2010, having inventors Avi Bar-Zeev and John Lewis and which is hereby incorporated by reference.

In one example, the adjuster 135 may be an actuator such as a piezoelectric motor. Other technologies for the actuator may also be used and some examples of such technologies are a voice coil formed of a coil and a permanent magnet, a magnetostriction element, and an electrostriction element.

There are different image generation technologies that can be used to implement microdisplay 120. For example, microdisplay 120 can be implemented using a transmissive projection technology where the light source is modulated by optically active material, backlit with white light. These technologies are usually implemented using LCD type displays with powerful backlights and high optical energy densities. Microdisplay 120 can also be implemented using a reflective technology for which external light is reflected and modulated by an optically active material. The illumination is forward lit by either a white source or RGB source, depending on the technology. Digital light processing (DLP), liquid crystal on silicon (LCOS) and Mirasol® display technology from Qualcomm, Inc. are all examples of reflective technologies which are efficient as most energy is reflected away from the modulated structure and may be used in the system described herein. Additionally, microdisplay 120 can be implemented using an emissive technology where light is generated by the display. For example, a PicoP™ engine from Microvision, Inc. emits a laser signal with a micro mirror steering either onto a tiny screen that acts as a transmissive element or beamed directly into the eye (e.g., laser).

Figure 4B:
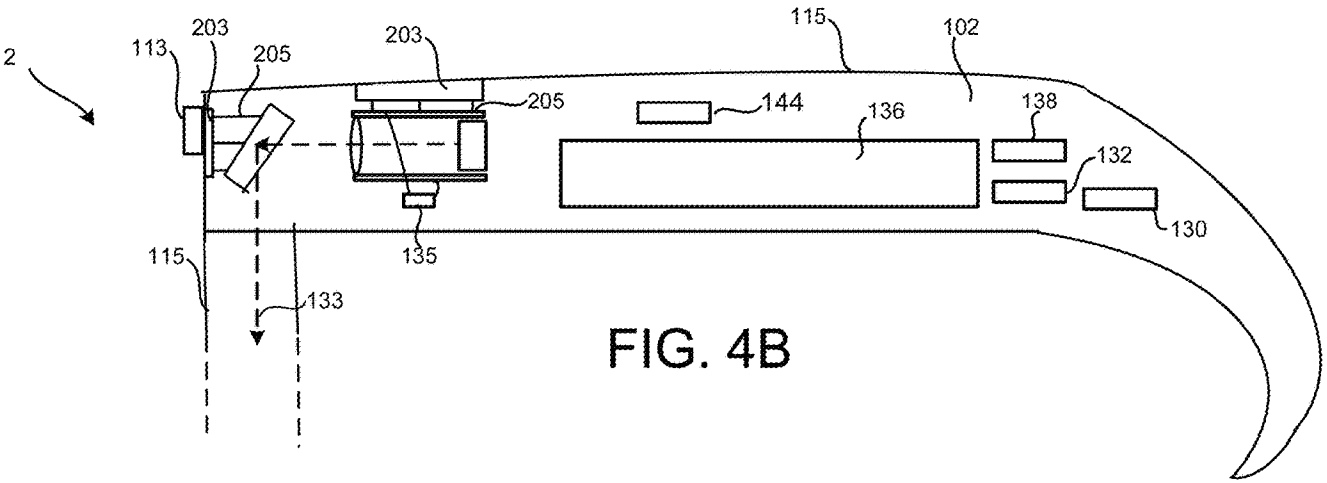
FIG. 4B is a side view of an eyeglass temple in an embodiment of a mixed reality display device providing support for hardware and software components and three dimensional adjustment of a microdisplay assembly.

FIG. 4B is a side view of an eyeglass temple in another embodiment of a mixed reality display device providing support for hardware and software components and three dimensional adjustment of a microdisplay assembly. Some of the numerals illustrated in the FIG. 5A above have been removed to avoid clutter in the drawing. In embodiments where the display optical system 14 is moved in any of three dimensions, the optical elements represented by reflecting element 124 and the other elements of the microdisplay assembly 173, e.g. 120, 122 may also be moved for maintaining the optical path 133 of the light of a virtual image to the display optical system. An XYZ transport mechanism in this example made up of one or more motors represented by display adjustment mechanism 203 and shafts 205 under control of the processor 210 of control circuitry 136 (see FIG. 6A) control movement of the elements of the microdisplay assembly 173. An example of motors which may be used are piezoelectric motors. In the illustrated example, one motor is attached to the armature 137 and moves the variable focus adjuster 135 as well, and another display adjustment mechanism 203 controls the movement of the reflecting element 124.

Figure 5B:
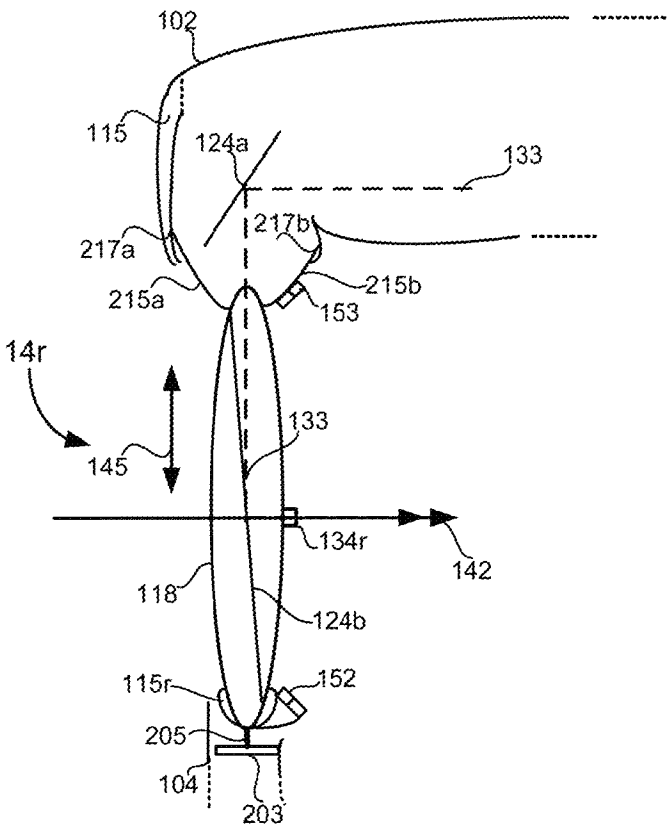
FIG. 5B is a top view of another embodiment of a movable display optical system of a see-through, near-eye, mixed reality device including an arrangement of gaze detection elements.
Figure 5A:
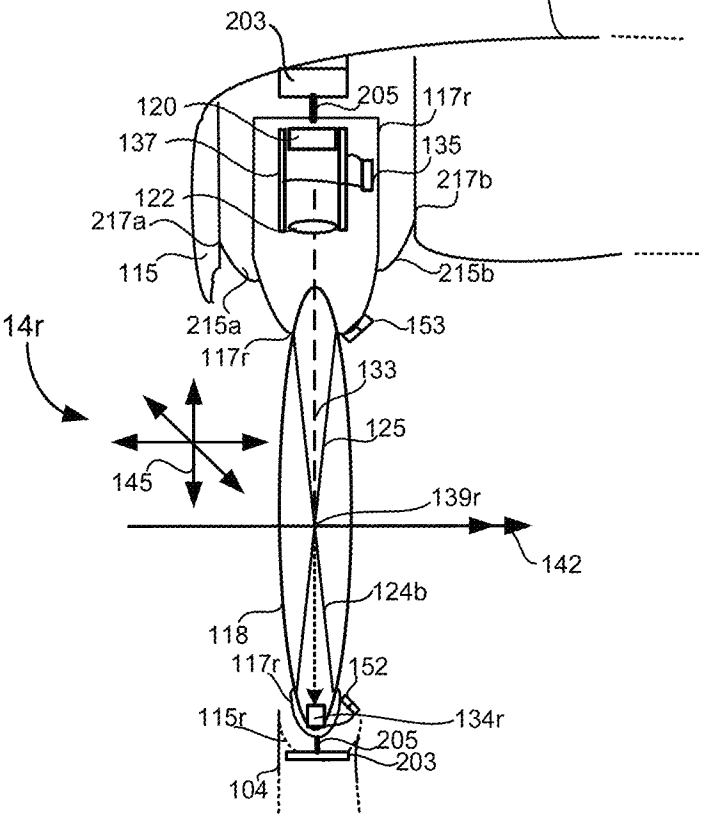
FIG. 5A is a top view of an embodiment of a movable display optical system of a see-through, near-eye, mixed reality device including an arrangement of gaze detection elements.

FIG. 5A is a top view of an embodiment of a movable display optical system 14 of a see-through, near-eye, mixed reality device 2 including an arrangement of gaze detection elements. A portion of the frame 115 of the near-eye display device 2 will surround a display optical system 14 and provides support for elements of an embodiment of a microdisplay assembly 173 including microdisplay 120 and its accompanying elements as illustrated. In order to show the components of the display system 14, in this case display optical system 14*r* for the right eye system, a top portion of the frame 115 surrounding the display optical system is not depicted. Additionally, the microphone 110 in bridge 104 is not shown in this view to focus attention on the operation of the display adjustment mechanism 203. As in the example of FIG. 4C, the display optical system 14 in this embodiment is moved by moving an inner frame 117*r*, which in this example surrounds the microdisplay assembly 173 as well. The display adjustment mechanism 203 is embodied in this embodiment provided as three axis motors which attach their shafts 205 to inner frame 117*r* to translate the display optical system 14, which in this embodiment includes the microdisplay assembly 173, in any of three dimensions as denoted by symbol 145 indicating three (3) axes of movement.

The display optical system 14 in this embodiment has an optical axis 142 and includes a see-through lens 118 allowing the user an actual direct view of the real world. In this example, the see-through lens 118 is a standard lens used in eye glasses and can be made to any prescription (including no prescription). In another embodiment, see-through lens 118 can be replaced by a variable prescription lens. In some embodiments, see-through, near-eye display device 2 will include additional lenses.

The display optical system 14 further comprises reflecting reflective elements 124*a* and 124*b*. In this embodiment, light from the microdisplay 120 is directed along optical path 133 via a reflecting element 124*a* to a partially reflective element 124*b* embedded in lens 118 which combines the virtual object image view traveling along optical path 133 with the natural or actual direct view along the optical axis 142 so that the combined views are directed into a user's eye, right one in this example, at the optical axis, the position with the most collimated light for a clearest view.

A detection area of a light sensor is also part of the display optical system 14*r*. An optical element 125 embodies the detection area by capturing reflected light from the user's eye received along the optical axis 142 and directs the captured light to the sensor 134*r*, in this example positioned in the lens 118 within the inner frame 117*r*. As shown, the arrangement allows the detection area 139 of the sensor 134*r* to have its center aligned with the center of the display optical system 14. For example, if sensor 134*r* is an image sensor, sensor 134*r* captures the detection area 139, so an image captured at the image sensor is centered on the optical axis because the detection area 139 is. In one example, sensor 134*r* is a visible light camera or a combination of RGB/IR camera, and the optical element 125 includes an optical element which reflects visible light reflected from the user's eye, for example a partially reflective mirror.

In other embodiments, the sensor 134*r* is an IR sensitive device such as an IR camera, and the element 125 includes a hot reflecting surface which lets visible light pass through it and reflects IR radiation to the sensor 134*r*. An IR camera may capture not only glints, but also an infra-red or near infra-red image of the user's eye including the pupil.

In other embodiments, the IR sensor 134*r* is a position sensitive device (PSD), sometimes referred to as an optical position sensor. The depiction of the light directing elements, in this case reflecting elements, 125, 124, 124*a* and 124*b* in FIGS. 5A-5D are representative of their functions. The elements may take any number of forms and be implemented with one or more optical components in one or more arrangements for directing light to its intended destination such as a camera sensor or a user's eye.

Figure 6A:
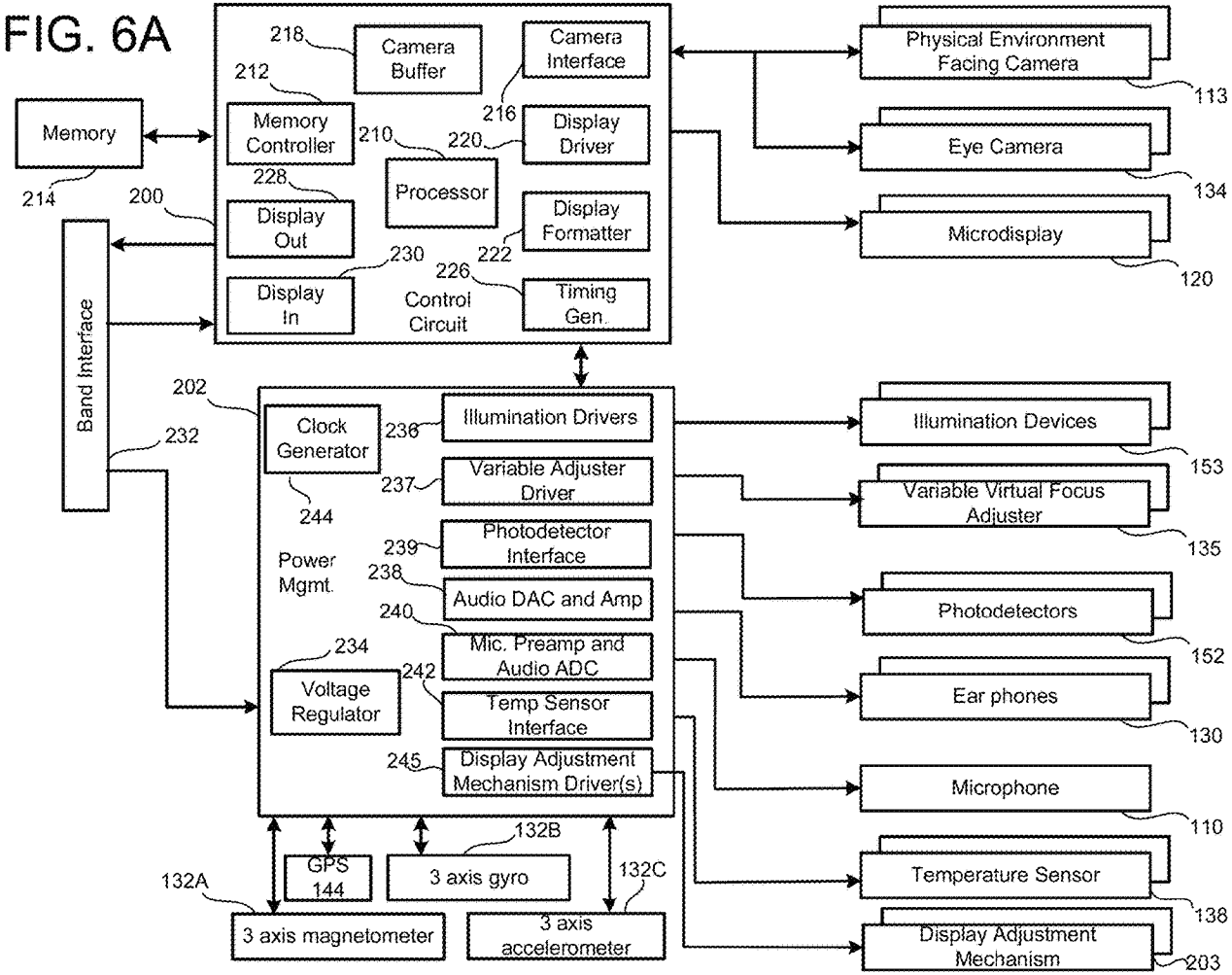
FIG. 6A is a block diagram of one embodiment of hardware and software components of a see-through, near-eye, mixed reality display unit as may be used with one or more embodiments.

As discussed in FIGS. 2A and 2B above and in the Figures below, when the user is looking straight ahead, and the center of the user's pupil is centered in an image captured of the user's eye when a detection area 139 or an image sensor 134*r* is effectively centered on the optical axis of the display, the display optical system 14*r* is aligned with the pupil. When both display optical systems 14 are aligned with their respective pupils, the distance between the optical centers matches or is aligned with the user's inter-pupillary distance. In the example of FIG. 6A, the inter-pupillary distance can be aligned with the display optical systems 14 in three dimensions.

In one embodiment, if the data captured by the sensor 134 indicates the pupil is not aligned with the optical axis, one or more processors in the processing unit 4 or the control circuitry 136 or both use a mapping criteria which correlates a distance or length measurement unit to a pixel or other discrete unit or area of the image for determining how far off the center of the pupil is from the optical axis 142. Based on the distance determined, the one or more processors determine adjustments of how much distance and in which direction the display optical system 14*r* is to be moved to align the optical axis 142 with the pupil. Control signals are applied by one or more display adjustment mechanism drivers 245 to each of the components, e.g. display adjustment mechanism 203, making up one or more display adjustment mechanisms 203. In the case of motors in this example, the motors move their shafts 205 to move the inner frame 117*r* in at least one direction indicated by the control signals. On the temple side of the inner frame 117*r* are flexible sections 215*a*, 215*b* of the frame 115 which are attached to the inner frame 117*r* at one end and slide within grooves 217*a* and 217*b* within the interior of the temple frame 115 to anchor the inner frame 117 to the frame 115 as the display optical system 14 is move in any of three directions for width, height or depth changes with respect to the respective pupil.

In addition to the sensor, the display optical system 14 includes other gaze detection elements. In this embodiment, attached to frame 117*r* on the sides of lens 118, are at least two (2) but may be more, infra-red (IR) illuminators 153 which direct narrow infra-red light beams within a particular wavelength range or about a predetermined wavelength at the user's eye to each generate a respective glint on a surface of the respective cornea. In other embodiments, the illuminators and any photodiodes may be on the lenses, for example at the corners or edges. In this embodiment, in addition to the at least 2 infra-red (IR) illuminators 153 are IR photodetectors 152. Each photodetector 152 is sensitive to IR radiation within the particular wavelength range of its corresponding IR illuminator 153 across the lens 118 and is positioned to detect a respective glint. As shown in FIGS. 4A-4C, the illuminator and photodetector are separated by a barrier 154 so that incident IR light from the illuminator 153 does not interfere with reflected IR light being received at the photodetector 152. In the case where the sensor 134 is an IR sensor, the photodetectors 152 may not be needed or may be an additional glint data capture source. With a visible light camera, the photodetectors 152 capture light from glints and generate glint intensity values.

In FIGS. 5A-5D, the positions of the gaze detection elements, e.g. the detection area 139 and the illuminators 153 and photodetectors 152 are fixed with respect to the optical axis of the display optical system 14. These elements may move with the display optical system 14*r*, and hence its optical axis, on the inner frame, but their spatial relationship to the optical axis 142 does not change.

FIG. 5B is a top view of another embodiment of a movable display optical system of a see-through, near-eye, mixed reality device including an arrangement of gaze detection elements. In this embodiment, light sensor 134*r* may be embodied as a visible light camera, sometimes referred to as an RGB camera, or it may be embodied as an IR camera or a camera capable of processing light in both the visible and IR ranges, e.g. a depth camera. In this example, the image sensor 134*r* is the detection area 139*r*. The image sensor 134 of the camera is located vertically on the optical axis 142 of the display optical system. In some examples, the camera may be located on frame 115 either above or below see-through lens 118 or embedded in the lens 118. In some embodiments, the illuminators 153 provide light for the camera, and in other embodiments the camera captures images with ambient lighting or light from its own light source. Image data captured may be used to determine alignment of the pupil with the optical axis. Gaze determination techniques based on image data, glint data or both may be used based on the geometry of the gaze detection elements.

In this example, the display adjustment mechanism 203 in bridge 104 moves the display optical system 14*r* in a horizontal direction with respect to the user's eye as indicated by directional symbol 145. The flexible frame portions 215*a* and 215*b* slide within grooves 217*a* and 217*b* as the system 14 is moved. In this example, reflecting element 124*a* of an microdisplay assembly 173 embodiment is stationery. As the IPD is typically determined once and stored, any adjustment of the focal length between the microdisplay 120 and the reflecting element 124*a* that may be done may be accomplished by the microdisplay assembly, for example via adjustment of the microdisplay elements within the armature 137.

Figure 5D:
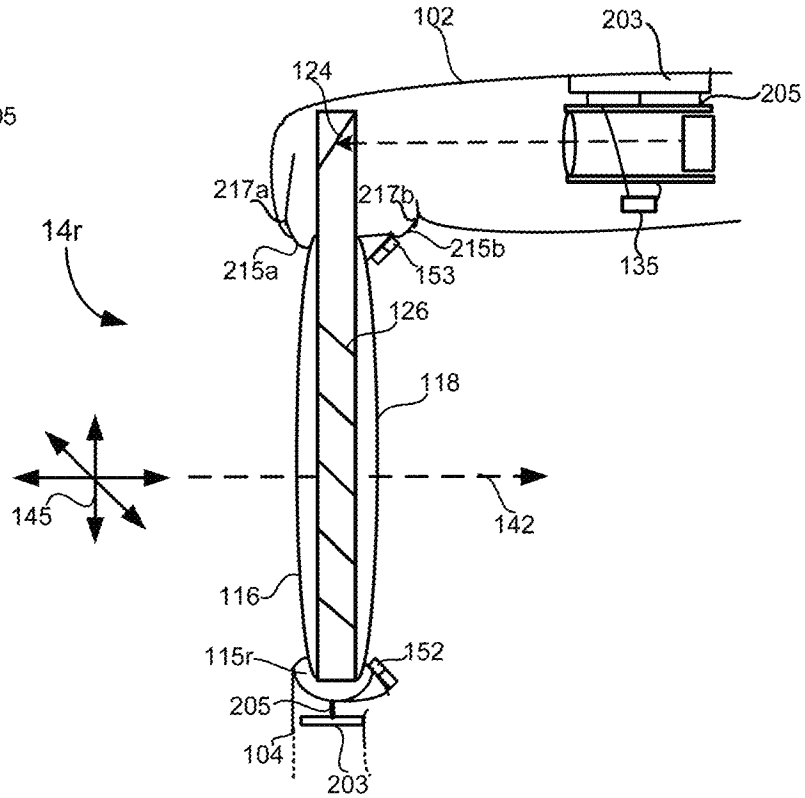
FIG. 5D is a top view of a fourth embodiment of a movable display optical system of a see-through, near-eye, mixed reality device including an arrangement of gaze detection elements.
Figure 5C:
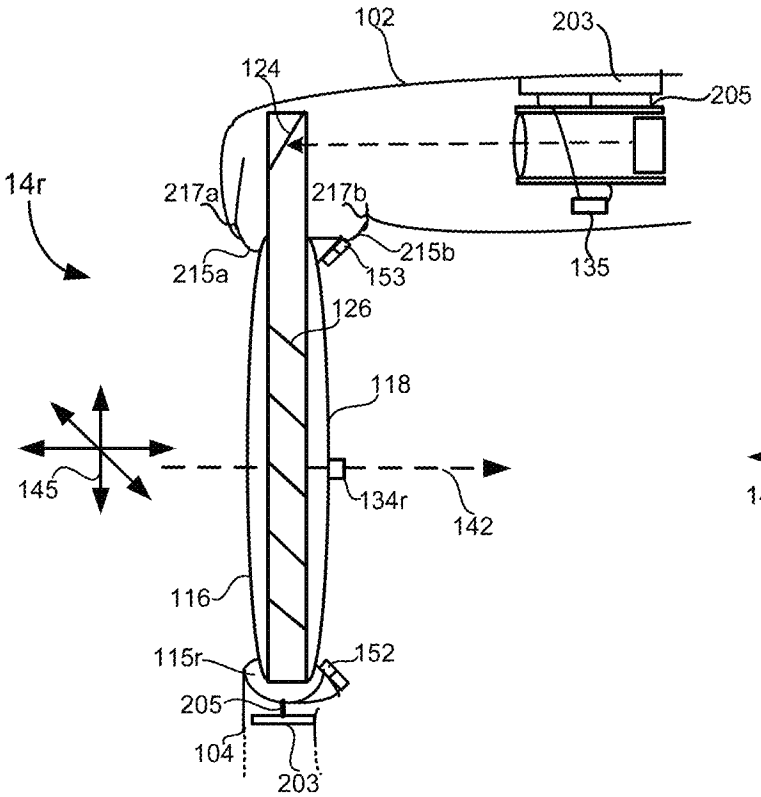
FIG. 5C is a top view of a third embodiment of a movable display optical system of a see-through, near-eye, mixed reality device including an arrangement of gaze detection elements.

FIG. 5C is a top view of a third embodiment of a movable display optical system of a see-through, near-eye, mixed reality device including an arrangement of gaze detection elements. The display optical system 14 has a similar arrangement of gaze detection elements including IR illuminators 153 and photodetectors 152, and a light sensor 134*r* located on the frame 115 or lens 118 below or above optical axis 142. In this example, the display optical system 14 includes a light guide optical element 112 as the reflective element for directing the images into the user's eye and is situated between an additional see-through lens 116 and see-through lens 118. As reflecting element 124 is within the lightguide optical element and moves with the element 112, an embodiment of a microdisplay assembly 173 is attached on the temple 102 in this example to a display adjustment mechanism 203 for the display optical system 14 embodied as a set of three axis mechanism 203 with shafts 205 include at least one for moving the microdisplay assembly. One or more display adjustment mechanism 203 on the bridge 104 are representative of the other components of the display adjustment mechanism 203 which provides three axes of movement. In another embodiment, the display adjustment mechanism may operate to move the devices via their attached shafts 205 in the horizontal direction. The mechanism 203 for the microdisplay assembly 173 would also move it horizontally for maintaining alignment between the light coming out of the microdisplay 120 and the reflecting element 124. A processor 210 of the control circuitry (see FIG. 7A) coordinates their movement.

Lightguide optical element 112 transmits light from microdisplay 120 to the eye of the user wearing head mounted display device 2. Lightguide optical element 112 also allows light from in front of the head mounted display device 2 to be transmitted through lightguide optical element 112 to the user's eye thereby allowing the user to have an actual direct view of the space in front of head mounted display device 2 in addition to receiving a virtual image from microdisplay 120. Thus, the walls of lightguide optical element 112 are see-through. Lightguide optical element 112 includes a first reflecting element 124 (e.g., a mirror or other surface). Light from microdisplay 120 passes through lens system 122 and becomes incident on reflecting element 124. The reflecting element 124 reflects the incident light from the microdisplay 120 such that light is trapped inside a planar, substrate comprising lightguide optical element 112 by internal reflection.

After several reflections off the surfaces of the substrate, the trapped light waves reach an array of selectively reflecting surfaces 126. Note that only one of the five surfaces 126 to prevent over-crowding of the drawing. Reflecting surfaces 126 couple the light waves incident upon those reflecting surfaces out of the substrate into the eye of the user. More details of a lightguide optical element can be found in United States Patent Application Publication 2008/0285140, Ser. No. 12/214,366, published on Nov. 20, 2008, "Substrate-Guided Optical Devices" incorporated herein by reference in its entirety. In one embodiment, each eye will have its own lightguide optical element 112.

FIG. 5D is a top view of a fourth embodiment of a movable display optical system of a see-through, near-eye, mixed reality device including an arrangement of gaze detection elements. This embodiment is similar to FIG. 5C's embodiment including a light guide optical element 112. However, the only light detectors are the IR photodetectors 152, so this embodiment relies on glint detection only for gaze detection as discussed in the examples below.

In the embodiments of FIGS. 5A-5D, the positions of the gaze detection elements, e.g. the detection area 139 and the illuminators 153 and photodetectors 152 are fixed with respect to each other. In these examples, they are also fixed in relation to the optical axis of the display optical system 14.

In the embodiments above, the specific number of lenses shown are just examples. Other numbers and configurations of lenses operating on the same principles may be used. Additionally, in the examples above, only the right side of the see-through, near-eye display device 2 are shown. A full near-eye, mixed reality display device would include as examples another set of lenses 116 and/or 118, another lightguide optical element 112 for the embodiments of FIGS. 5C and 5D, another microdisplay 120, another lens system 122, likely another environment facing camera 113, another eye tracking sensor 134 for the embodiments of FIGS. 6A to 6C, earphones 130, and a temperature sensor 138.

Figure 6B:
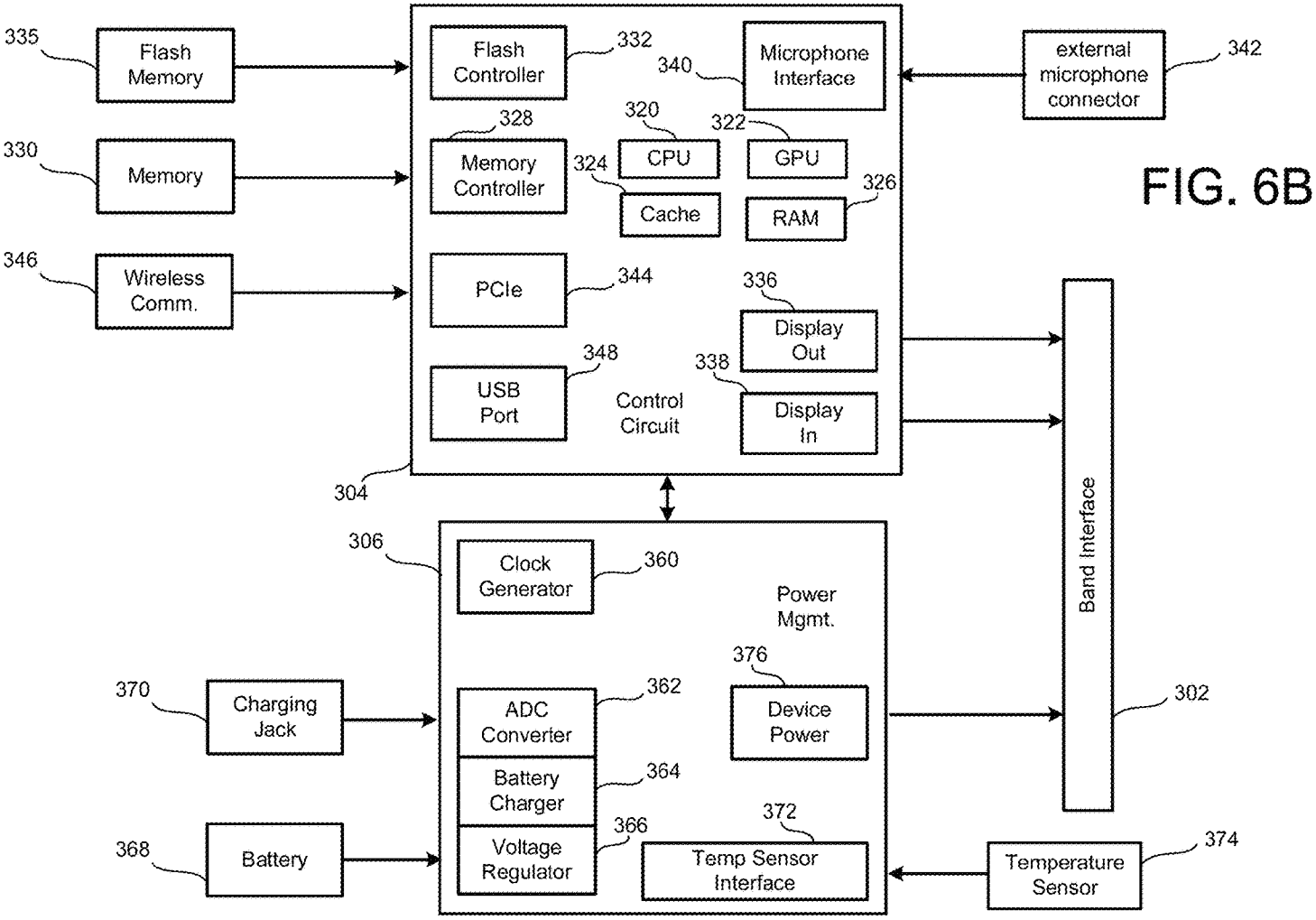
FIG. 6B is a block diagram of one embodiment of the hardware and software components of a processing unit associated with a see-through, near-eye, mixed reality display unit.

FIG. 6A is a block diagram of one embodiment of hardware and software components of a see-through, near-eye, mixed reality display unit 2 as may be used with one or more embodiments. FIG. 7B is a block diagram describing the various components of a processing unit 4. In this embodiment, near-eye display device 2, receives instructions about a virtual image from processing unit 4 and provides the sensor information back to processing unit 4. Software and hardware components which may be embodied in a processing unit 4 are depicted in FIG. 6B, will receive the sensory information from the display device 2 (See FIG. 1A). Based on that information, processing unit 4 will determine where and when to provide a virtual image to the user and send instructions accordingly to the control circuitry 136 of the display device 2.

Note that some of the components of FIG. 6A (e.g., physical environment facing camera 113, eye sensor 134, variable virtual focus adjuster 135, detection area 139, microdisplay 120, illuminators 153, earphones 130, temperature sensor 138, display adjustment mechanism 203) are shown in shadow to indicate that there are at least two of each of those devices, at least one for the left side and at least one for the right side of head mounted display device 2. FIG. 6A shows the control circuit 200 in communication with the power management unit 202. Control circuit 200 includes processor 210, memory controller 212 in communication with memory 214 (e.g., D-RAM), camera interface 216, camera buffer 218, display driver 220, display formatter 222, timing generator 226, display out 228, and display in interface 230. In one embodiment, all of components of driver 220 are in communication with each other via dedicated lines of one or more buses. In another embodiment, each of the components of control circuit 200 are in communication with processor 210.

Camera interface 216 provides an interface to the two physical environment facing cameras 113 and each eye sensor 134 and stores respective images received from the cameras 113, 134 in camera buffer 218. Display driver 220 will drive microdisplay 120. Display formatter 222 may provide information, about the virtual image being displayed on microdisplay 120 to one or more processors of one or more computer systems, e.g. 4, 210 performing processing for the augmented reality system. Timing generator 226 is used to provide timing data for the system. Display out 228 is a buffer for providing images from physical environment facing cameras 113 and the eye cameras 134 to the processing unit 4. Display in 230 is a buffer for receiving images such as a virtual image to be displayed on microdisplay 120. Display out 228 and display in 230 communicate with band interface 232 which is an interface to processing unit 4.

Power management unit 202 includes voltage regulator 234, eye tracking illumination driver 236, variable adjuster driver 237, photodetector interface 239, audio DAC and amplifier 238, microphone preamplifier and audio ADC 240, temperature sensor interface 242, display adjustment mechanism driver(s) 245 and clock generator 244. Voltage regulator 234 receives power from processing unit 4 via band interface 232 and provides that power to the other components of head mounted display device 2. Illumination driver 236 controls, for example via a drive current or voltage, the illuminators 153 to operate about a predetermined wavelength or within a wavelength range. Audio DAC and amplifier 238 receives the audio information from earphones 130. Microphone preamplifier and audio ADC 240 provides an interface for microphone 110. Temperature sensor interface 242 is an interface for temperature sensor 138. One or more display adjustment drivers 245 provide control signals to one or more motors or other devices making up each display adjustment mechanism 203 which represent adjustment amounts of movement in at least one of three directions. Power management unit 202 also provides power and receives data back from three axis magnetometer 132A, three axis gyro 132B and three axis accelerometer 132C. Power management unit 202 also provides power and receives data back from and sends data to GPS transceiver 144.

The variable adjuster driver 237 provides a control signal, for example a drive current or a drive voltage, to the adjuster 135 to move one or more elements of the microdisplay assembly 173 to achieve a displacement for a focal region calculated by software executing in a processor 210 of the control circuitry 13, or the processing unit 4, or both. In embodiments of sweeping through a range of displacements and, hence, a range of focal regions, the variable adjuster driver 237 receives timing signals from the timing generator 226, or alternatively, the clock generator 244 to operate at a programmed rate or frequency.

The photodetector interface 239 performs any analog to digital conversion needed for voltage or current readings from each photodetector, stores the readings in a processor readable format in memory via the memory controller 212, and monitors the operation parameters of the photodetectors 152 such as temperature and wavelength accuracy.

FIG. 6B is a block diagram of one embodiment of the hardware and software components of a processing unit 4 associated with a see-through, near-eye, mixed reality display unit. The processing unit 4 may include this embodiment of hardware and software components as well as similar components which perform similar functions. FIG. 6B shows controls circuit 304 in communication with power management circuit 306. Control circuit 304 includes a central processing unit (CPU) 320, graphics processing unit (GPU) 322, cache 324, RAM 326, memory control 328 in communication with memory 330 (e.g., D-RAM), flash memory controller 332 in communication with flash memory 335 (or other type of non-volatile storage), display out buffer 336 in communication with see-through, near-eye display device 2 via band interface 302 and band interface 232, display in buffer 338 in communication with near-eye display device 2 via band interface 302 and band interface 232, microphone interface 340 in communication with an external microphone connector 342 for connecting to a microphone, PCI express interface for connecting to a wireless communication component 346, and USB port(s) 348.

In one embodiment, wireless communication component 346 can include a Wi-Fi enabled communication device, Bluetooth communication device, infrared communication device, etc. The USB port can be used to dock the processing unit 4 to a secondary computing device in order to load data or software onto processing unit 4, as well as charge processing unit 4. In one embodiment, CPU 320 and GPU 322 are the main workhorses for determining where, when and how to insert images into the view of the user.

Power management circuit 306 includes clock generator 360, analog to digital converter 362, battery charger 364, voltage regulator 366, see-through, near-eye display power interface 376, and temperature sensor interface 372 in communication with temperature sensor 374 (located on the wrist band of processing unit 4). An alternating current to digital converter 362 is connected to a charging jack 370 for receiving an AC supply and creating a DC supply for the system. Voltage regulator 366 is in communication with battery 368 for supplying power to the system. Battery charger 364 is used to charge battery 368 (via voltage regulator 366) upon receiving power from charging jack 370. Device power interface 376 provides power to the display device 2.

The system described above can be used to add virtual images to a user's view such that the virtual images are mixed with real images that the user see. In one example, the virtual images are added in a manner such that they appear to be part of the original scene. Examples of adding the virtual images can be found U.S. patent application Ser. No. 13/112,919, "Event Augmentation With Real-Time Information," filed on May 20, 2011; and U.S. patent application Ser. No. 12/905,952, "Fusing Virtual Content Into Real Content," filed on Oct. 15, 2010; both applications are incorporated herein by reference in their entirety.

To provide a mixed reality environment wherein virtual objects rendered by a display device interact with real objects in the field of view of a user, an object-centric tracking system is implemented. The object-centric tracking system uses a standard definition for each instance of a real world object and a rendered virtual object. This allows each processing unit 4 and computing system 12 to understand and process objects, both real and virtual, in a manner that is consistent across all devices and allows each rendering device to perform the calculations to render correct interactions between the objects in the field of view.

Figure 7A:
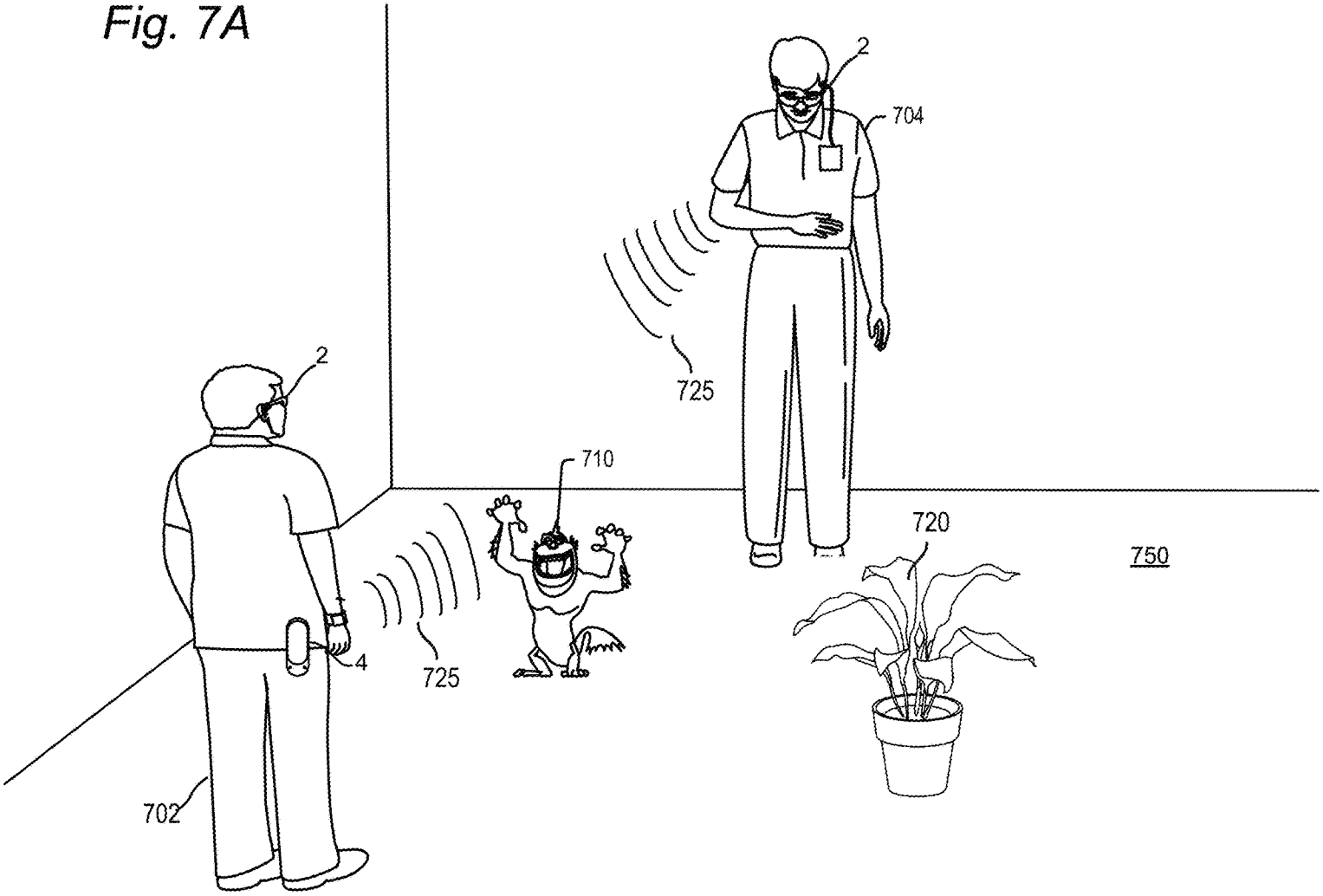
FIG. 7A is a depiction of an environment with a real and a virtual object.
Figure 7B:
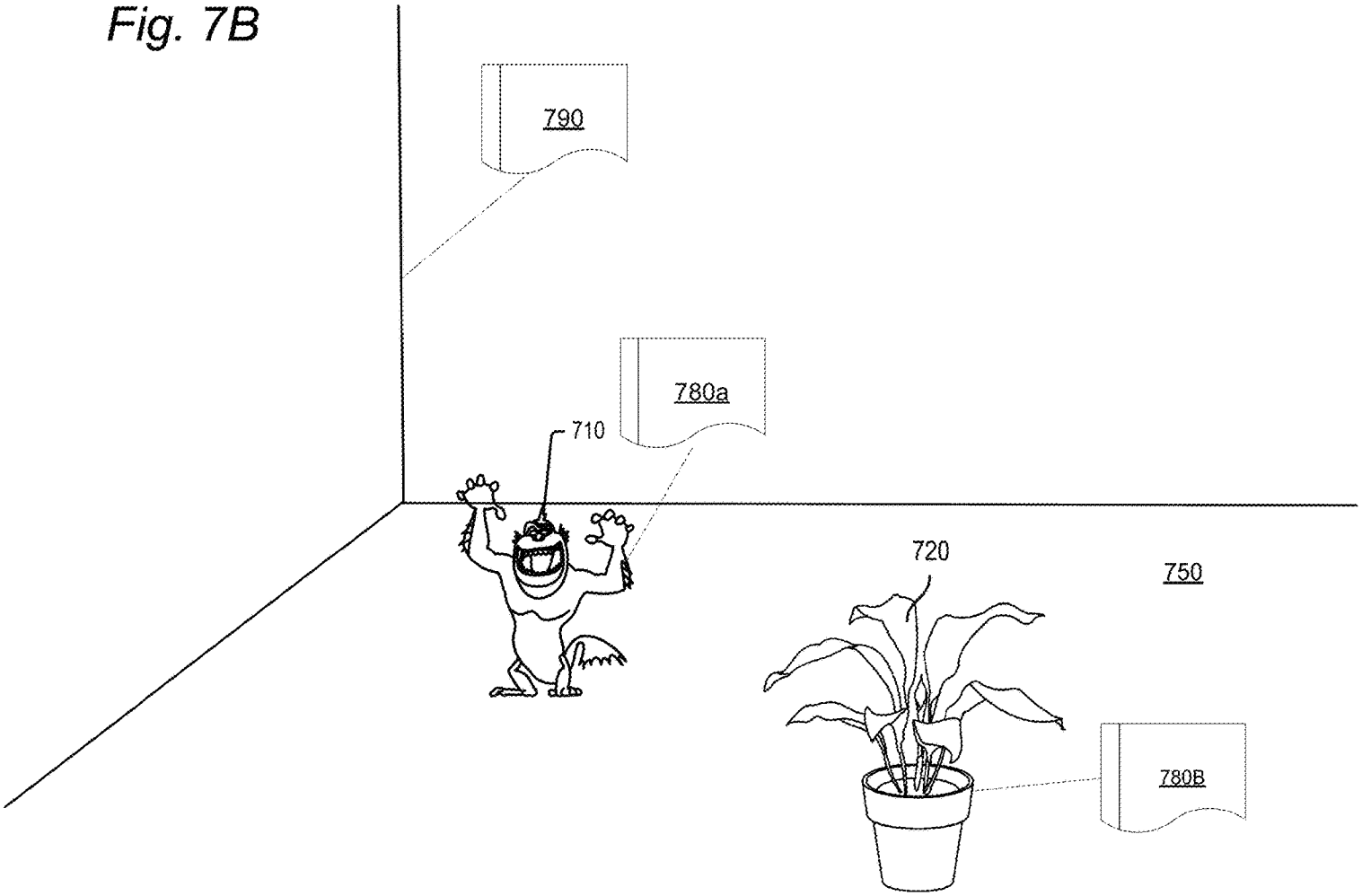
FIG. 7B is a depiction of object instances linked to each real and virtual object, and the environment.

FIG. 7*a* illustrates a scenario by two users 702 and 704 each wearing a see through head mounted display device share a view of a physical environment 750. User 702 has a view of a virtual object 710 and a real object 720. Virtual object 710 is a rendered, three dimensional holographic object provided by the see through head mounted display device 2. Real object 720 is a physical, real world object, which is shown in this example to be a plant. Both the virtual object 710 and the real object 720 have properties and behaviors. For a physical object, physical properties and behaviors are well known and understood. For example, the plant has a volume, a weight, a mass, and reactions as forces such as gravity are applied to it. That is, if you push the plant it will move until the forces of friction and gravity restrict its movement; if you drop the plant from a particular height it will fall to the ground.

Virtual object 710 may have properties which are defined by the system rendering the object. That is, the object 710 will behave in one of a number of different manners as outlined in FIG. 8.

In accordance with the technology, both the virtual object 710 and the real object 720 are defined using a common object definition used to create individual instances of each object. Instances of each object can be displayed and manipulated by display systems 10 alone, in conjunction with peer-connected systems 10, or through an object management service. Each virtual and each real object in the operating environment—the user field of view and environment—of a system 10 is characterized using the same definition structure, allowing individual systems to handle interactions between virtual objects and other virtual objects, and virtual objects and real objects, which are within the purview of the system.

For example, if the virtual monster object 710 runs across the room and into the plant, several scenarios are possible. In one scenario, the monster may run through the plant. In another scenario, the monster may hit the plant like hitting a wall and be knocked over. In yet another scenario, the monster may knock over the plant, which may be illustrated by the system generating a virtual plant and showing it knocked over while obfuscating the real object. Each of these scenarios, as well as other possible scenarios, can be determined and generated for a viewing user (e.g. users 702 and 704) based on the object definitions.

User 702 and 704 may be in wireless communication as illustrated by signal 725. Communication between users 702 and 704 may be peer-to-peer or may be provided via a centralized object management service that tracks instances of objects for users in various environments. It may be understood that there may be multiple users in a single physical environment, and the use of two users in this particular example is merely illustrative.

FIG. 7B illustrates an association between individual object instances 780A and 780B, and objects 710 and 720. An environment definition 790 may include a three dimensional map of the environment 750 as well as object definitions for object instances which may be created within the environment 750. Each environment definition may comprise a mapping defined in terms of real objects. Real objects may be translated into virtual objects to create a virtual object environment definition. As such, virtual objects may be created from real objects and may include virtual features such as walls, doors and/or other room features.

It should be further recognized that once an object definition for a real object is created, a virtual object equivalent to that real object may be created. For example, if a real object is defined for a real dog, that real object definition can be converted to a virtual object based on the characteristics recognized for the dog. Physical characteristics can be input based on device inputs to create shape, texture and other physical elements, while behaviors and physical actions of the dog can be understood from a generic object definition, or added as recognized by the system.

Figure 8A:
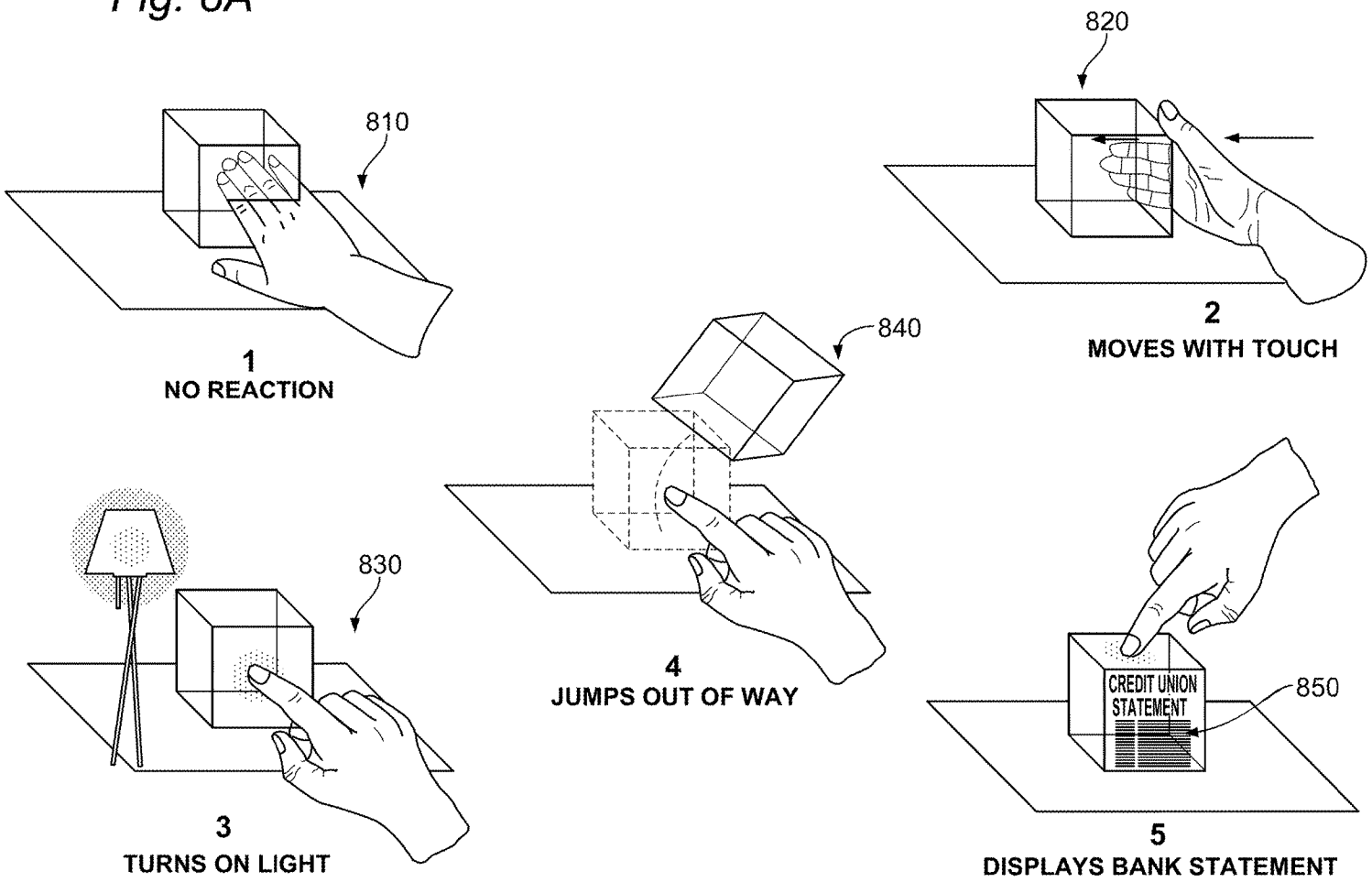
FIG. 8A is a block diagram illustrating different types of hologram virtual objects.

FIG. 8A illustrates the different types of behaviors that a particular holographic virtual object, such as object 710, may have. Object type 1 illustrated by object 810 is a simple projection or illusion, having no physical properties or functions. The object is static and when touched by a human hand, the hand passes through the object as if the object were transparent. There is no interaction with the object by the user but rather the object provides a basic appearance and visual properties. The object has a position in space and can be located by particular coordinates, and may, in some circumstances have an idle animation.

Object 820 is a responsive virtual object. The responsive virtual object moves with touch and registers location and user contact when a user's hand, for example, engages the object. Object 820 responds when it is interacted with and is active. The object is touchable; that is, the user can touch the object and move it, and supports basic interactions and animations. It may have programmable characteristics and behaviors that are parallel to but not necessarily restricted to reality or real based objects.

Object 830 is a third object type and comprises a functional object. The function of the object is an action or response that controls, for example, a secondary element. The function may be a virtual or a real world action. However, the type of interaction with the functional object 830 may not necessarily have any relation to a real world interaction. In the example shown at 830, object 830 turned on a light. Interaction with object 830 triggers a programmed response based on the gestural interaction with the object.

Object 840 is a smart object. Smart objects can have an independent reaction to a user interaction, and can include a retained memory from the last interaction. The smart object when interacted with in the example shown on FIG. 8, jumps out of the way when touched by a user. The smart object has intelligence or agency and is auto responsive to its environment. The smart object can have motion without user interaction and such motion may be organic or inorganic.

Finally, object 850 which is a complex object. The complex object triggers a complex chain of events or commands, in a manner much like a traditional computer. For example, object 850 displays a bank statement when touched. A complex object 850 may have all the functionality of a traditional computer and may become in any form. The object 850 is fully interactive and is constantly aware and analyzing its environment.

As discussed below, objects are created based on a definition accessed by an object identifier. The object identifier may be a non-unique, statistically unique, or unique identifier for an object or a class of objects. Each instance of an object can be registered relative to a person, object or environment to allow that instance to be both rendered in space and found by other objects.

Figure 8B:
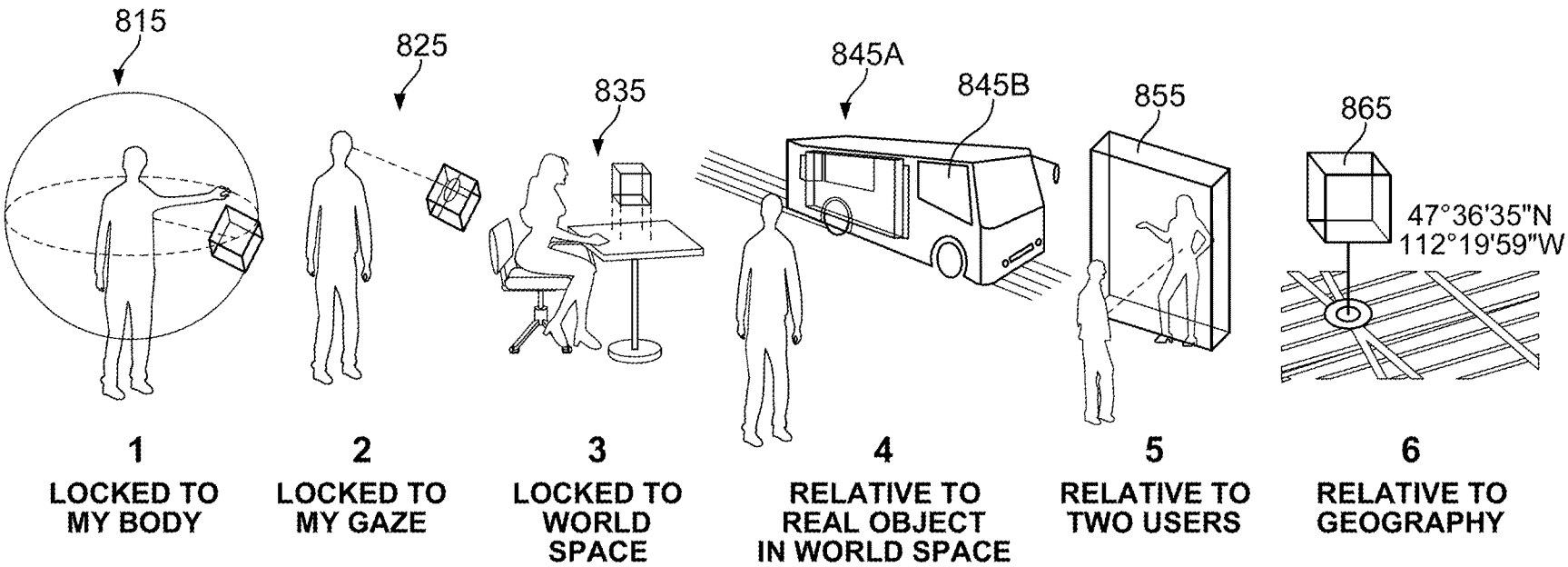
FIG. 8B is an illustration of the relation of objects.

FIG. 8B illustrates examples of how objects such as those illustrated in FIG. 7A and FIG. 8A are understood relative to their environment. All objects may be registered to another object, their environment, or a person. In the example shown in FIG. 8B, at 815, the object is registered to a person. In this case, the object is locked to the user's body. Object 825 is likewise object linked to a person, but in this case linked to the user's gaze. Object 835 is locked to a world space or environment. In this case, the object 835 is registered to a position within the local environment space of a particular user. Similarly, at 845, an object 845A is linked to a bus 845B, but is linked relative to a real world object in world space. At 855, the object is linked to one of two users, but is presented relative to two users. An object 855 can be registered to either world space, or a local environment, or either of the two users shown in FIG. 8B. Object 865 is registered relative to world space, or world geography. When registered to a world space, object 865 has an absolute position relative to geographic coordinates.

It may be understood that where a user allows personal information such as location, biometric or identification information to be used by the system 10, the user may be asked to take an affirmative action before the data is collected. In addition or in the alternative, a user may be provided with the opportunity take an affirmative action to prevent the collection of data before that data is collected. This consent may be provided during an initialization phase of the system 10.

FIG. 9 illustrates a general method for rendering and tracking objects in accordance with the present technology. It may be understood that the method of FIG. 9 is performed by a see through head mounted display device 2 in conjunction with the processing unit 4. In some contexts, the steps of FIG. 9 may be performed by a server device in conjunction with the see through head mounted display device 2. Certain steps in the process of FIG. 9 are not illustrated. For example, when a user first puts a see through head mounted display device on, an initialization sequence will register the movements of the user to the device, additionally, user's position in a global coordinate system, such as a global positioning system (GPS) may be determined. Alternatively, once initialized, the system is prepared to understand the object registration.

At step 1002, the user's location, orientation, and gaze within the display device to are determined. The user's gaze, orientation and location will determine the user's field of view and what objects are within the user's field of view and may be within the user's potential field of view in his surrounding environment. It may be understood that the user's location may be a relative location. That is, the location may not be a location relative to any world positioning system, but may be registered to a local environment where the user is located or relative to the user himself. At 1004, the physical environment is determined. One method for determining the physical environment involves mapping the user's real world environment using data gathered by the see through head mounted display device 2. This mapping step can determine the physical boundaries of the user's environment as well as determining which objects are within the physical environment. At step 1006, real objects and virtual objects within user environment are determined. Step 1006 can be performed by using data gathered by display device 2 from which real items within the user's environment are identified. Alternatively, a stored environment known to contain certain real and virtual objects ban be used. For example, if the user is sitting in the user's living room, it is likely that the user's previous definition of this environment will be known and can be used by the display device 2. That is, the furniture will likely not have moved, the television will remain in the same place, and the table and chairs will also be in the same positions they were before. Even slight movements of these physical objects could be recognized by the system. Once real objects in the environment are known and identified, the real world objects are mapped to real world object definitions. Object definitions are described below with respect to FIG. 13.

Once all real world objects are identified at 1006, virtual objects for rendering in the user environment at 1006 are determined. The determination of virtual objects at 1006 may occur in a number of ways. In one embodiment, virtual objects are provided by an application running within the processing device for of the display system. Different applications may allow users to use virtual objects in different ways. In one example, virtual objects can be displayed to allow users to play games or interact with virtual monsters such as those shown in FIG. 7A.

As noted briefly above, each real object and each virtual object is characterized in the system by an object definition. The object definition is addressed by an object identifier. The object definition is used to create an instance of each object to the see through head mounted display device. In certain embodiments, each instance is assigned an identifier which may be non-unique, statistically unique, or unique and the instance of the object is registered to the global object management service. In other cases, the instance of this object may be non-unique, statistically unique, or unique to the rendering system (each display system comprising a see through head mounted display to and processing device for) and can be shared with other systems either through the object management system, or on a peer to peer basis Once the virtual objects are determined at 1006, the virtual objects which may to be rendered in an user field of view are determined at 1008. Not all virtual objects in a user environment may be rendered in a user field of view. Whether an object is to be rendered depends on where the user is looking and their position relative to the virtual objects. Once field of view objects are determined at 1008, objects are rendered in the mixed reality view by device 2 at step 1010. At 1012, the system then handles interactions based on object rules and system filters as described below.

Object interaction comprises the interactions between virtual objects and real world objects, and virtual objects and other virtual objects. Real objects interact with real objects in known manners and in ways that cannot be altered by a display system. It will be understood that a display system can obfuscate the view of interactions of real objects, but cannot control them. However, when a virtual object encounters a real object, or a virtual object encounters another virtual object, collisions and occlusions may occur. This requires the display system to handle interactions between these objects by knowing where the positions are, and the properties of the object.

FIG. 10A is a flowchart illustrating the methods of steps 1006 for determining real objects and virtual objects in an environment.

At step 1020, data from one or more sensory devices on the display device 2 is received. At 1025, one or more real objects in the field of view of the sensors are identified and assigned to the environment. Identification of objects at 1025 comprises assigning the object definition and creating an instance of a real world object definition such as that shown at FIG. 13. At 1030, virtual object positions within the user environment are identified.

Figure 10C:
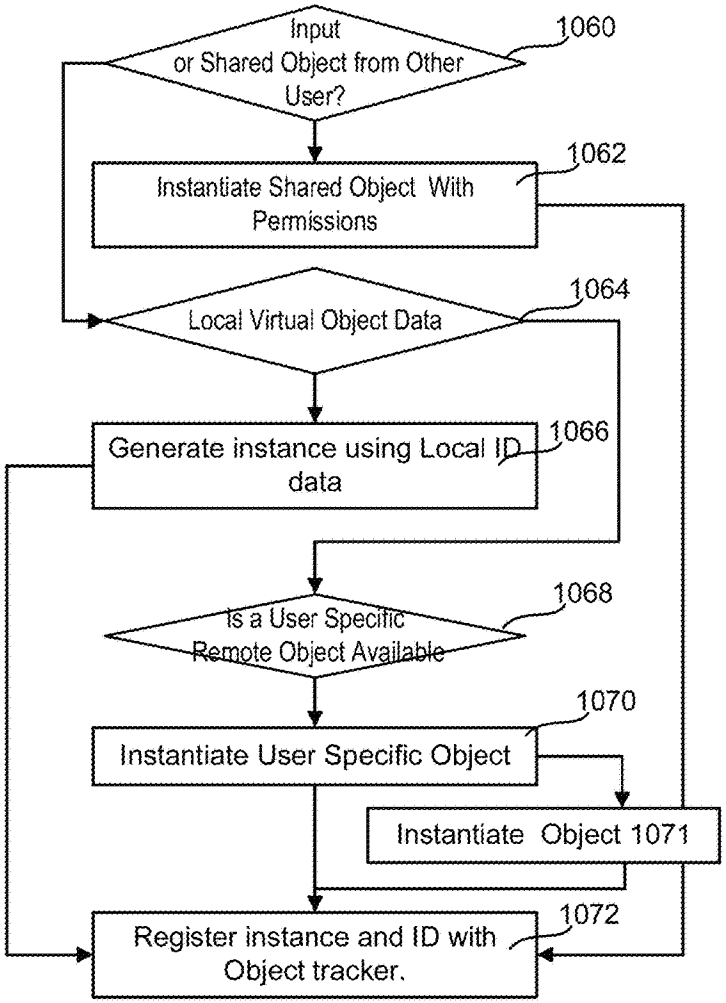
FIG. 10C is a flowchart illustrating a step in FIG. 10A for creating an object instance of a virtual object.
Figure 10B:
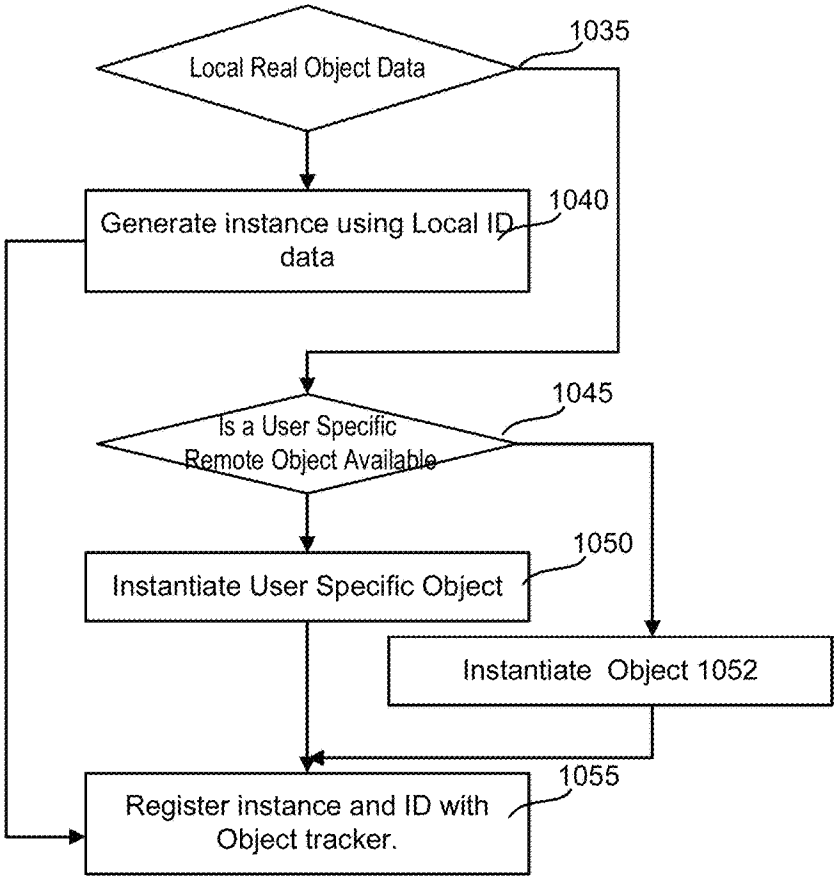
FIG. 10B is a flowchart illustrating a step in FIG. 10A for creating an object instance of a real object.

FIG. 10B illustrates one method for performing step 1025 in identifying one or more real objects.

Figure 12:
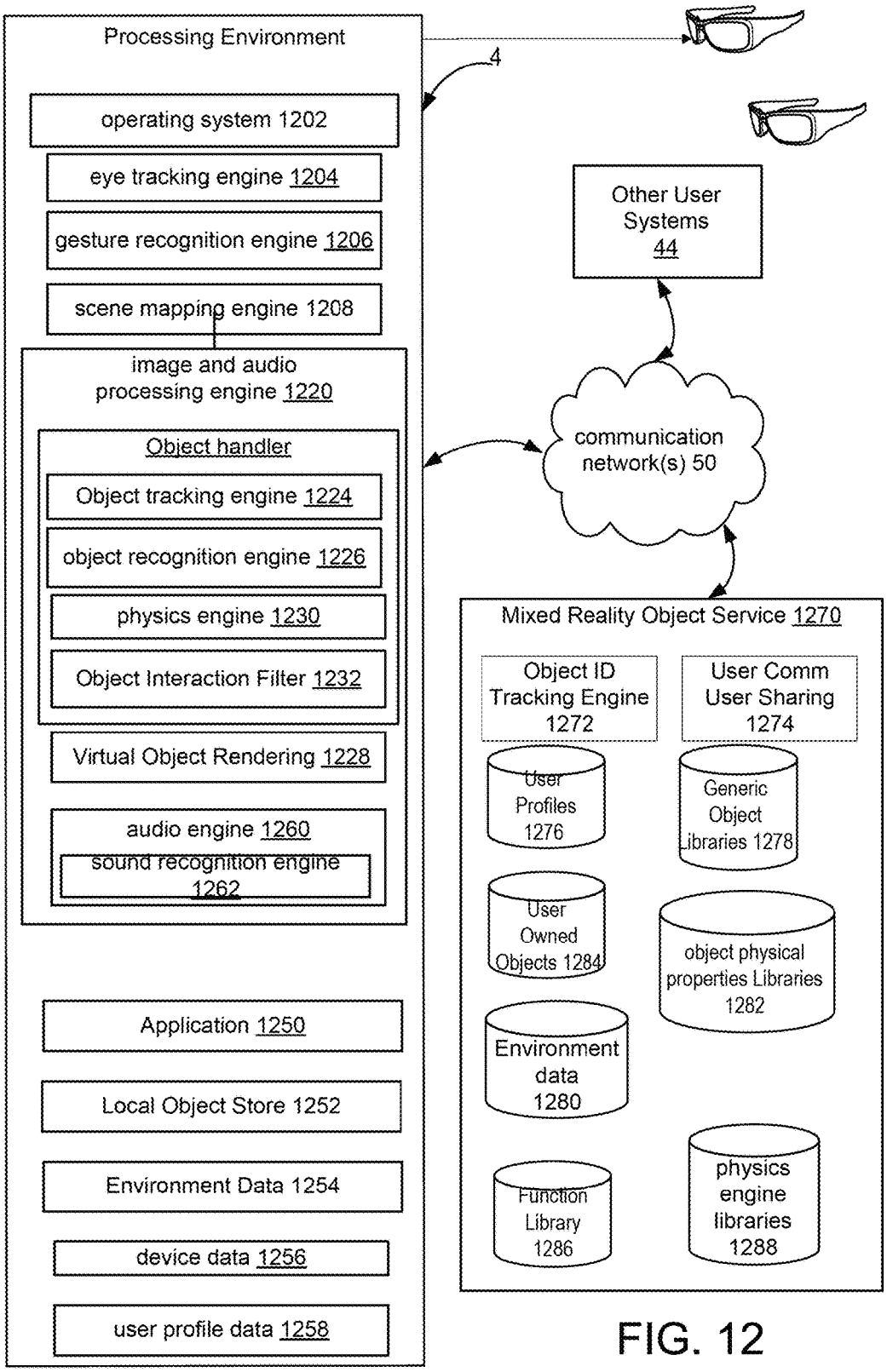
FIG. 12 is a block diagram of software functions in a processing unit of a see through head mounted display device.

At 1025, a determination is made as to whether a local definition of a real object is accessible to a system 10. As illustrated in FIG. 12, object definitions may be stored with the processing unit 4 or with a mixed reality object handling service 1270. Much like a web page is served on a local computer and cached for later use, a local, cached version of the object definition may exist at 1035. If the local object exists, then an instance of the object is generated at 1040 using a local object definition. If no local object exists, then an object definition may be retrieved from the object management service. At 1045, a determination is made as to whether a user-specific remote object is available. Object instances and object definitions may be associated with users as owners. Such user-specific objects may be stored locally or remotely, and may comprise generic or customized versions (with, for example default values for certain attributes in an object definition) of object definitions. The remote object may be linked to a person, object or environment. That is, the user-specific object may be an object specifically defined for an environment that a user is in or may be an object that is related to another object that is in the user's environment. If the object is user specific, then the user's individual version of the physical object will be retrieved from the object database and the object instantiated at 1050. If not, a generic definition of the object will be retrieved and the instance created at 1052 from the generic object definition. At 1055, the instance is specifically identified and may be registered with the object tracker either locally, at the object management service, or both.

FIG. 10C illustrates one method for performing step 1030 of locating and tracking virtual objects. Virtual objects may be created by an application associated with or running on the processing unit 4, or may be shared from other users. At 1060, an initial determination is made as to whether an object is received as input from another user. If so, at 1062 the shared object from the other user will be instantiated with the object definition provided by the other user including any limitation placed on viewing or interacting with the shared object by the user. At 1064, if the object is not a shared object, (and in a manner similar to step 1035) a determination is made as to whether a local virtual object exists. If so, a virtual object is created using local object data at 1066. If not, at 1068, a determination is made as to whether a use specific remote object is available. If so, the user object is instantiated at 1070 and if not, an object using a generic definition is instantiated at 1071. At 1072, the instance is specifically identified and may be registered with the object tracker either locally, at the object management service, or both.

Figure 11:
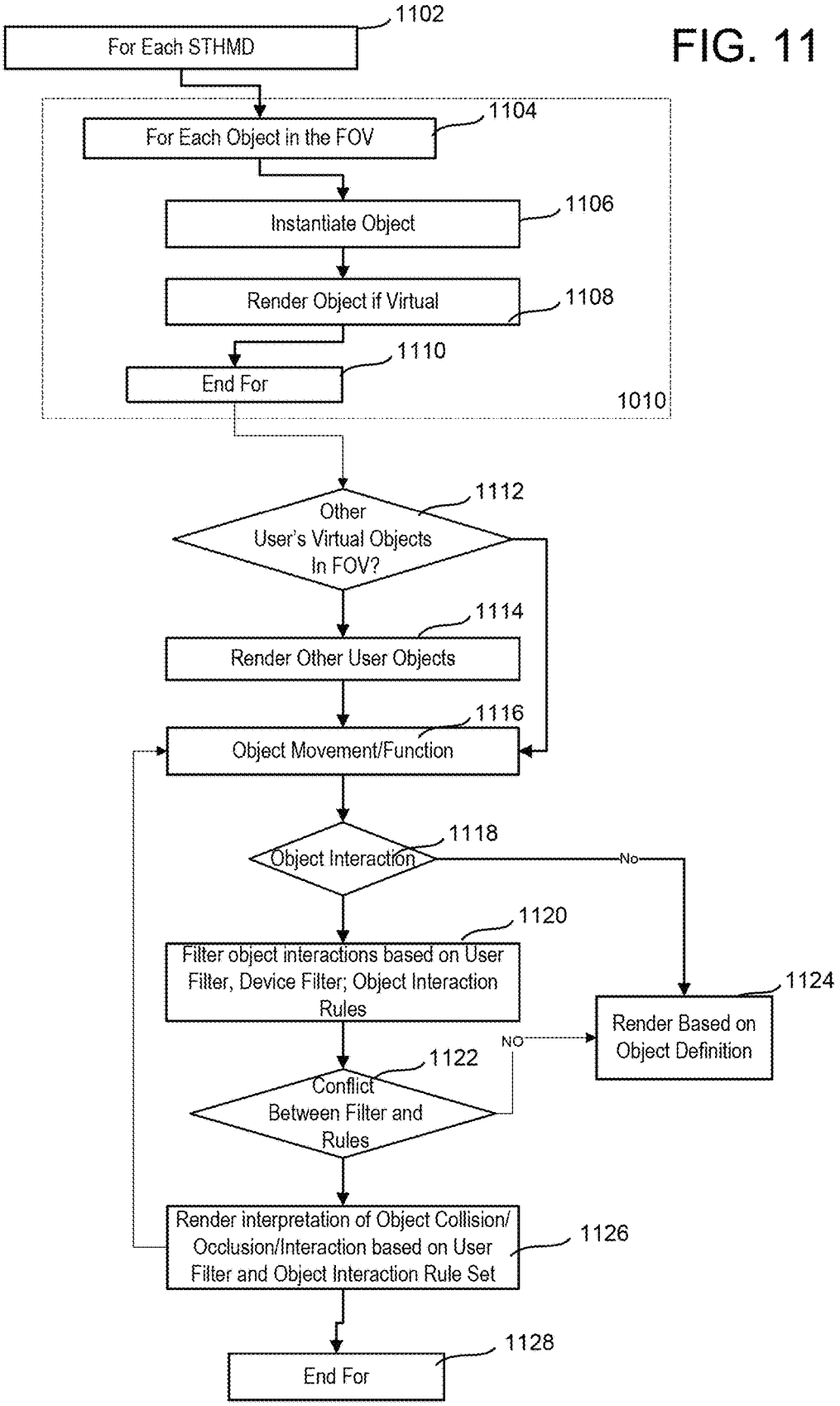
FIG. 11 is a flowchart illustrating steps of FIG. 9 for rendering and managing interactions between real and virtual objects.

FIG. 11 illustrates a method of performing steps 1010 and 1012 of FIG. 9. For each see through head mounted display at 1102, and for each object in the field of view at 1104, an object is instantiated at 1106 and if the object is virtual, the object is rendered at 1108. As noted above, each object is associated with an object definition such as that shown in FIG. 13. This includes both real and virtual objects within the user's field of view.

At 1112, a determination is made as to whether another user's virtual objects are within a given user's field of view. Within a particular see through head mounted display device (step 1102) other users (such as the two users shown in FIG. 7A) may likewise have virtual objects and may be sharing those virtual objects with each other. Where users have shared virtual objects, an understanding between the two devices as to how the devices objects will interact may be recognized. If the objects are shared, then at step 1114, the other user's objects are rendered within the display of each user's field of view. Once the object moves at step 1116, a determination is made at 1118 as to whether or not object interaction between a real object and a virtual object or two virtual objects occurs at 1118. If no interaction occurs, then the objects are simply rendered at 1124 according to the object's definition as reflected in the instance. If there is an object interaction at 1118, then object interactions are filtered based on the user filter associated with a see through head mounted display, and objection interaction rules defined with the particular object at 1120. If, at 1122, a conflict occurs between the rules of two different objects, or between the rules and a device filters parameters, an interpretation of the object collision occlusion interaction is made based upon user filter and object interaction rule set at 1126. If no conflict occurs, then the object is simply rendered based on the object definition 1124.

Figure 13:
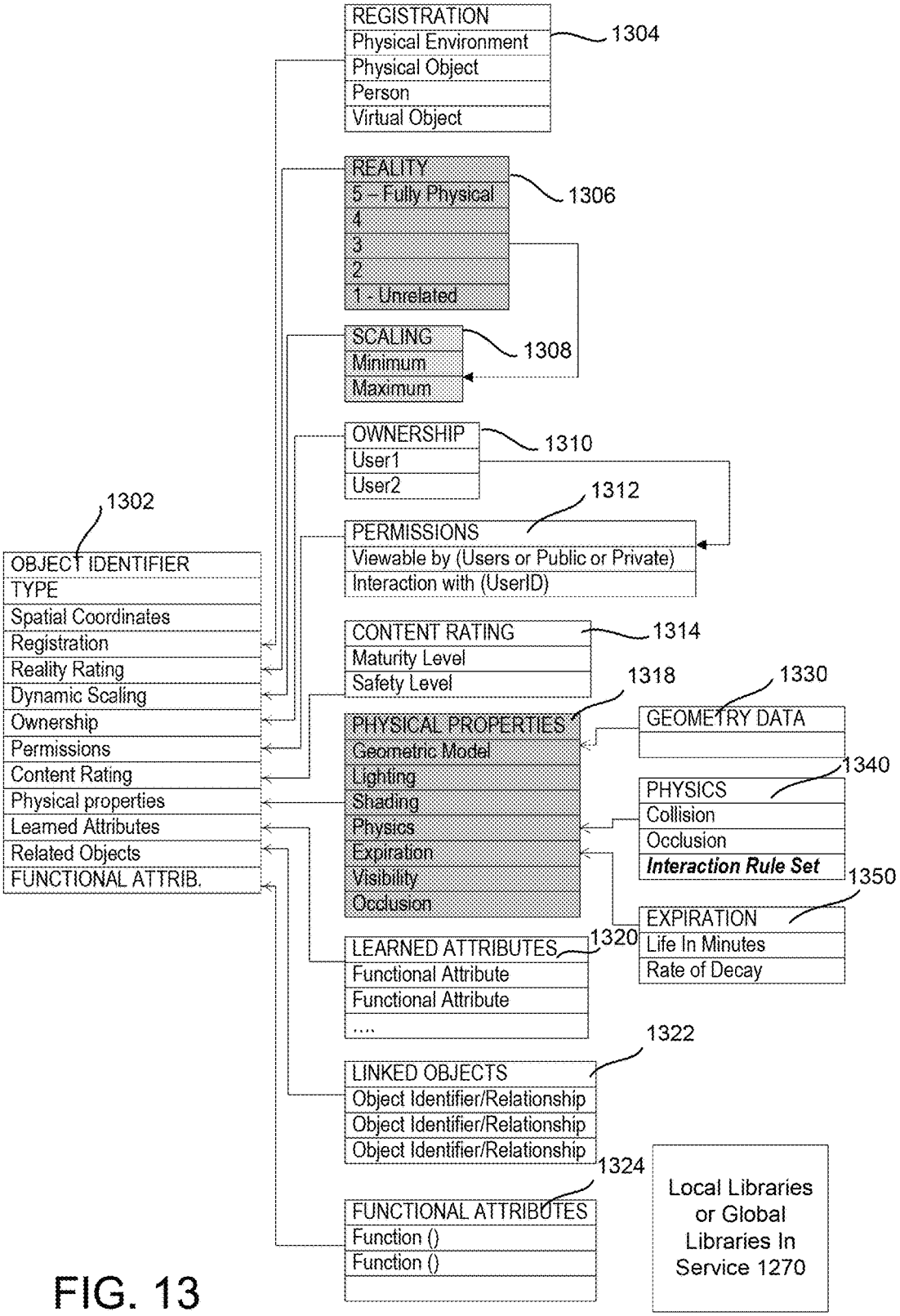
FIG. 13 is a diagram of an object structure.

Based on the definition of the objects set forth in FIG. 13, and the parameters of the processing device, object interactions are governed within the virtual holographic world viewed by a user of system 10 through display device 2. Each device may be equipped with an object interaction filter which is defined for a particular user. The object interaction filter can read components of the object definition set forth in FIG. 13 and apply particular rules of object interaction and object handling to a given user. For example, a juvenile user may have a different rule filter than an adult, allowing different types of objects to be viewed and interacted with in different ways. A straightforward example will be a content rating. Adults may be allowed to see more graphic or adult themed elements, while juveniles will be restricted to less severe themes. A user may be allowed to specify rules for the interaction filter to indicate desired user preferences.

As such, the interaction filter interprets object attributes at the rendering level of the device. The interaction filter in one embodiment makes no changes to the attributes of the object instance, merely the interpretation of the attributes to a particular user.

FIG. 12 illustrates the functional components of the processing environment for any mixed reality object handling service 1270 relative to communication networks 50 and other user systems. FIG. 12 is a block diagram of the system from a software perspective for providing a mixed reality environment within see through head mounted mixed reality display. FIG. 12 illustrates a computing environment from a software perspective which may be implemented by personal AV apparatus to, one or more remote computing systems 12 in communication with one or more personal AV apparatus, or a combination of these. Network connectivity allows leveraging available computing resources including a mixed reality object service 1270.

As shown in the embodiment of FIG. 12, the software components of a processing unit 4 comprise an operating system 1202, eye tracking engine 1204, gesture recognition engine 1206, scene mapping engine 1208, image and audio processing engine 1220, image and audio processing engine 1220 including object handler 1222, mixed reality application 1250, a local object store 1252, environment data 1254, device data 1256, user profile data 1258, and an audio engine 1260. Not illustrated are image and audio data buffers which provide memory for receiving image data captured from hardware elements on the device 2.

Operating system 1202 provides the underlying structure to allow hardware elements in the processing unit 4 to interact with the higher level functions of the functional components shown in FIG. 12.

Eye tracking engine 1204 tracks the user gaze with respect to movements of the eye relative to the device 2. Eye tracking engine 1204 can identify the gaze direction or a point of gaze based on people position and eye movements and determine a command or request.

Gesture recognition engine 1206 can identify actions performed by a user indicating a control or command to an executing application 1250. The action may be performed by a body part of a user e.g. a hand or a finger, but also may include a eye blink sequence. In one embodiment, the gesture recognition engine 1206 includes a collection of gesture filters, each comprising information concerning a gesture that may be performed by at least a part of a skeletal model. The gesture recognition engine 1206 compares skeletal model and movements associated with it derived from the captured image added to the gesture filters in a gesture library to identify when a user has performed one or more gestures. In some examples, matching an image data to image models of a user's hand or finger during a gesture may be used rather than skeletal tracking for recognizing gestures. Image and audio processing engine 1220 processes image data depth and audio data received from one or more captured devices which might be available in a given location.

Image and audio processing engine 1220 processes image data (e.g. video or image), depth and audio data received from one or more captured devices which may be available from the device. Image and depth information may come from outward facing sensors captured as the user moves his or her body. A 3D mapping of the display field of view of the augmented reality display 2 can be determined by the scene mapping engine 1208, based on captured image data and depth data for the display field of view. A depth map can represent the captured image data and depth data. A view dependent coordinate system may be used for mapping of the display field of view as how a collision between object appears to a user depends on the user's point of view. An example of the view dependent coordinate system is an X, Y, Z, coordinate system in which the Z-axis or depth axis extends orthogonally or as a normal from the front of a see through display device 2. At some examples, the image and depth data for the depth map are presented in the display field of view is received from cameras 113 on the front of display device 2. The display field of view may be determined remotely or using a set of environment data 1254 which is previously provided based on a previous mapping using the scene mapping engine 1208 or from environment data 1280 in a mixed object reality service.

The object handler 1222 includes an object tracking engine 1224 which tracks each of the objects in a user's field of view, both virtual and real, to object instances maintained in the processing unit 4. Each instance of each object is generated, maintained and destroyed by the object tracking engine 1224. Object recognition engine 1226 determines which objects, both real and virtual, are within a scene, allowing the tracking engine to use this object mapping for object instances. The object recognition engine utilizes data from the local object store 1252 environment data 1254 as well as objects which may be available from the mixed reality object service 1270 to recognize the real and virtual objects within the system.

Virtual object rendering engine 1228 renders each instance of a three dimensional holographic virtual object within the display of a display device 2. Object rendering engine 1228 works in conjunction with object tracking engine 1224 to track the positions of virtual objects within the display. The virtual objects rendering engine 1228 uses the object definition contained within the local object store as well as the instance of the object created in the processing engine 1220 and the definition of the objects visual and physical parameters to render the object within the device. The physics engine 1230 uses the physics data which is provided in the definition to control movement of any virtual objects rendered in the display. The object interaction filter 1232 is the device specific set of rules which interprets object definition to allow, prevent, or modify display parameters based on the specific settings of a user device. Local object store 1252 contains object definitions which may be associated with the user, or cached object definitions provided by a mixed reality object service 1270. Environment data 1254 may contain a three dimensional mapping of a user environment as well as one or more preconfigured environment comprising a series of objects associated with physical environment. Device data 1256 may include information identifying the specific device including an identifier for the processing unit 4 including, for example, a network address, an IP address, and other configuration parameters of the specific device in use.

User profile data 1258 includes user specific information such as user specific objects, and preferences associated with one or more users of the device.

In some embodiments, a mixed reality object service 1270 may be provided. The mixed reality object service 1270 may comprise one or more computers operating to provide a service via communication network 50 in conjunction with each of the processing unit 4 coupled as part of a mixed reality display system 10. The mixed reality object handling service 1270 can include an object ID tracking engine 1272, a user communication and sharing engine 1274, a user profile store 1276, generic object libraries 1278, user owned objects 1284, object physical properties libraries 1282, environment data 1280, functional libraries 1286 and physics engine libraries 1288.

As will become more clear in the description of FIG. 13 concerning the structure of an object definition, the mixed reality object service 1270 provides definitions of both virtual and real objects based a uniform object structure used for creating instances of real and virtual objects within a processing unit 4. In this context, generic object libraries 1278 can provide, for example, a generic object definition for a virtual or real object, and hence may contain real object definitions 1278*a* and virtual object definitions 1278*b*. The generic object definition, for example a definition for a virtual monster object 710 or real plant object 720 as shown in FIG. 7, can include a basic set of information for generating a monster or tracking a plant.

A modified instance can then be saved as a user specific or user owned object at 1284. This definition can be associated with the user and while sharing many characteristics with a generic object definition, can be customized with user specific changes. For example, the user may wish to change the generic color of a monster and this modification can be saved as a user owned object at 1284. The user profile store 1276 may include information identifying the user to the mixed reality object service 1270 and allowing that service to provide user owned objects and generic object libraries to different processing environments.

The generic object libraries 1278 access physical properties libraries 1282, physics engine libraries 1288 and function libraries 1286 in creating a generic object definition. The function library contains a variety of functions that can be linked to virtual objects to add functionality to the objects. Functions may or may not include interfaces to the real world environment that a user is present in. In the example shown in FIG. 8A where an object is used to turn on a light, the function includes an interface to a switch controlling the lights functions. Similar interfaces can be provided for myriad connections to real world impacts. Physics engine libraries 1288 contain physics definitions for virtual objects and physical properties libraries contain various physical properties, all of which can be combined in various manners to create different, custom objects.

Similarly, as a user modifies an instance of an object running on processing unit 4, additional functions from the function library, changes in the physics parameters of a virtual object from the physics engine libraries and changes to the object physical properties from the physical properties libraries, can be accessed by the user when making changes to specific virtual objects. Environment data 1280 can contain both user defined environments and previously defined three dimensional maps of specific locations.

The object ID tracking engine 1272 can receive uploads of the creation of a specific instance of a virtual or real object on any of a number of processing unit 4 coupled to the mixed reality object service. In this manner, users on other user systems 44 can become aware of the existence of instances of objects which have been created on the processing unit 4 as shown on FIG. 12. Likewise, users of processing unit 4 can be aware of instances of objects created by other user systems 44.

User communication and user sharing in 1274 allows users on other systems 44 to interact via the mixed reality object handling service 1270 with instances of the objects identified by the tracking engine 1272. Direct communication between the systems 44 and 4 may occur, or processing may be handled by the mixed object reality service. Such processing may include handling of collisions, occlusion, and other information. In one embodiment, each processing unit 4 includes an object tracking engine 1224 which tracks other user's objects as well as objects which are defined by the virtual object rendering engine 1228 and physics engine 1230 and object interaction filter 1232 definitions of the objects and the rules to ascertain how interactions between both user objects and objects from other users may be handled.

In one embodiment, sharing objects may comprise sharing an object definition associated with an object instance with another user. The processing unit of a second (shared) user may then create a separate instance of the shared object and render that object in accordance with the definition. The shared object definition may be dynamically updated by the sharing user so that changes to the sharing user's instance of the object are reflected to the shared user. It should be recognized that other alternatives for sharing objects exist.

FIG. 13 is a block diagram of an object definition. Each object definition includes core attributes 1302 which are extended and defined based on whether the object is virtual or physical. A core of attributes 1302 includes an object identifier, an object type, spatial coordinates, registration 1304, reality rating attribute 1306, a scaling factor 1308, an ownership record attribute 1310, permissions 1312, a content rating attribute 1314, physical properties attribute 1318, learned attributes 1320, linked objects 1322, and functional attributes 1324.

In the core attributes 1302, the object identifier is a reference to the object definition for any given object. The object definition identifies the object definition for every virtual and real object. In an aspect of the present technology, all objects tracked within the system, both real and virtual, contain the same basic object definition structure illustrated in FIG. 13.

Where an object is a real object, certain of the core attributes 1302, including the reality, scaling, and physical properties, (shown in gray in FIG. 13) will be predefined for real objects. Because, for example, reality rating attribute tracks whether an object can be fully real or fully virtual, and a real object exists and is tangible and therefore is fully real, this attribute is predefined. A real object has defined physical properties at 1318. Further, real objects cannot scale and thus have no real scaling factor at 1308.

The attribute object TYPE indicates whether the object is a basic, responsive, functional, smart, or computer object as illustrated in FIG. 8.

Instances of objects are registered to a person, environment or another object. The registration 1304 core attribute defines the registration of the object to an environment, object, or person. Registration is defined for both real or virtual objects. The registration attribute 1304 in conjunction with the spatial coordinates identifies the location of the object relative to the registration point. It may be noted that the physical environment in the registration object 1304 can constitute a position defined by a global positioning system.

The spatial coordinates attribute defines a physical location for the object. The physical location of an object can be identified by one corner of the object relative to the physical properties defined for the object, a center point of the object, or any point of reference consistently utilized by the processing environment to refer to the particular object. The spatial coordinates attribute is used in conjunction with the registration attribute 1304 to define the physical position of the object relative to the object, environment or person the object is registered to.

The reality attribute 1306 defines the spectrum of the acceptable physical properties versus the allowable disregard to acceptable physics.

The scaling attribute 1308 defines the properties of expansion and reduction for a particular object. Virtual objects can be scaled so that, for example, a television can fit an entire wall of a given room. This scaling attribute 1308 allows the object to have defined parameters of scale. The ownership attribute 1310 defines who owns the object and the attribute identifies owners of the object. As illustrated in FIG. 13, more than one user can own a particular object or instance of an object. The permissions attribute 1312 allows for digital rights management and ownership to be shared amongst the various users. This can allow other users to view and/or interact with a particular instance of an object or an object definition. This also defines the privacy and sharing capabilities of a particular instance of an object. Content rating attribute 1314 can comprise a safety level or a maturity rating for a particular object.

Physical properties attribute 1318 can include a number of elements used to define the natural state of the virtual object. Where the object is a physical object, as noted above, the physical properties will be defined by the state of existence of the object. A virtual object's natural state may be defined by parameters used by the rendering engine to render the virtual object within the system. This can include a default and static state of existence and its basic state. Physical properties include, for example, geometric model data (geometry data 1330) lighting information, shading information, physics properties (physics attribute 1340), an expiration attribute, visibility, and occlusion properties. The geometry data 1330 is a three dimensional model definition of the object used by the rendering engine to create the virtual object within the view of the user. Any number of standards or types of geometrical data can be utilized by the rendering engine to create three dimensional models within the view of a user. Physics attribute 1340 includes collision, occlusion, and an interaction rule set which is utilized by the physics engine and the rendering engine to define how objects interact with each other. For example, in the example shown in FIG. 8A, one object is simply a projection which a hand will pass through while another object will react based on the touch of a user. The physics of the object will be defined in the physics attribute 1340. How that object acts when it hits or interacts with another object is defined by the interaction rule set. For example, certain objects will be allowed to pass through walls, while a wall object may be defined as not allowing any objects to pass through it. For the case where two objects have conflicting physics definitions, the interaction rule set defines which object can take precedence. This can be used in conjunction with the filter for a particular device (the object interaction filter 1232) to define whether an object which is allowed to pass through any other object is allowed to pass through a wall defining that no objects can pass through it.

Functional attributes 1324 comprise the items utilized by a functional object, smart object and computer object when they are interacted with. The functional attributes can comprise a library of functions which are linked to local libraries or global libraries in the mixed reality object handling service 1270 which enable the object to have any number of different functions relative to command sets that are provided when interacting with the object. Learned attributes can be additional functional attributes linked to the global libraries or to other objects allowing a default object to take on additional functional attributes. For example, a dog may have a number of functional attributes 1324 allowing it to respond to commands from a user. However, the user may instruct the dog that it may wish the dog to fly. And attach the functional attribute of flying to the learned attribute of the dog. Linked objects 1322 define relationships between objects and other virtual objects in a system. Linked attributes define relationships between moving objects and objects contained within other objects. For example, if the plant in FIG. 7 is placed on a table, the plant object may be linked to the table to allow a movement of the table to affect the movement of the object. Likewise, in the example shown in FIG. 8B at 815, where the billboard is linked to a bus, in one case, the bus can be defined as an environment but in another case the bus may be defined as a virtual object and the objects linked together. In yet another embodiment, objects can be contained within other objects. For example, a virtual cup of coffee may utilize both an object "coffee" as well as an object "cup". The coffee object may be linked to the cup object in a manner allowing the coffee to be constrained within the cup. And interpret actions of the cup which would result in spilling the coffee to actually generate the physical movement of the coffee out of the cup.

Figure 14:
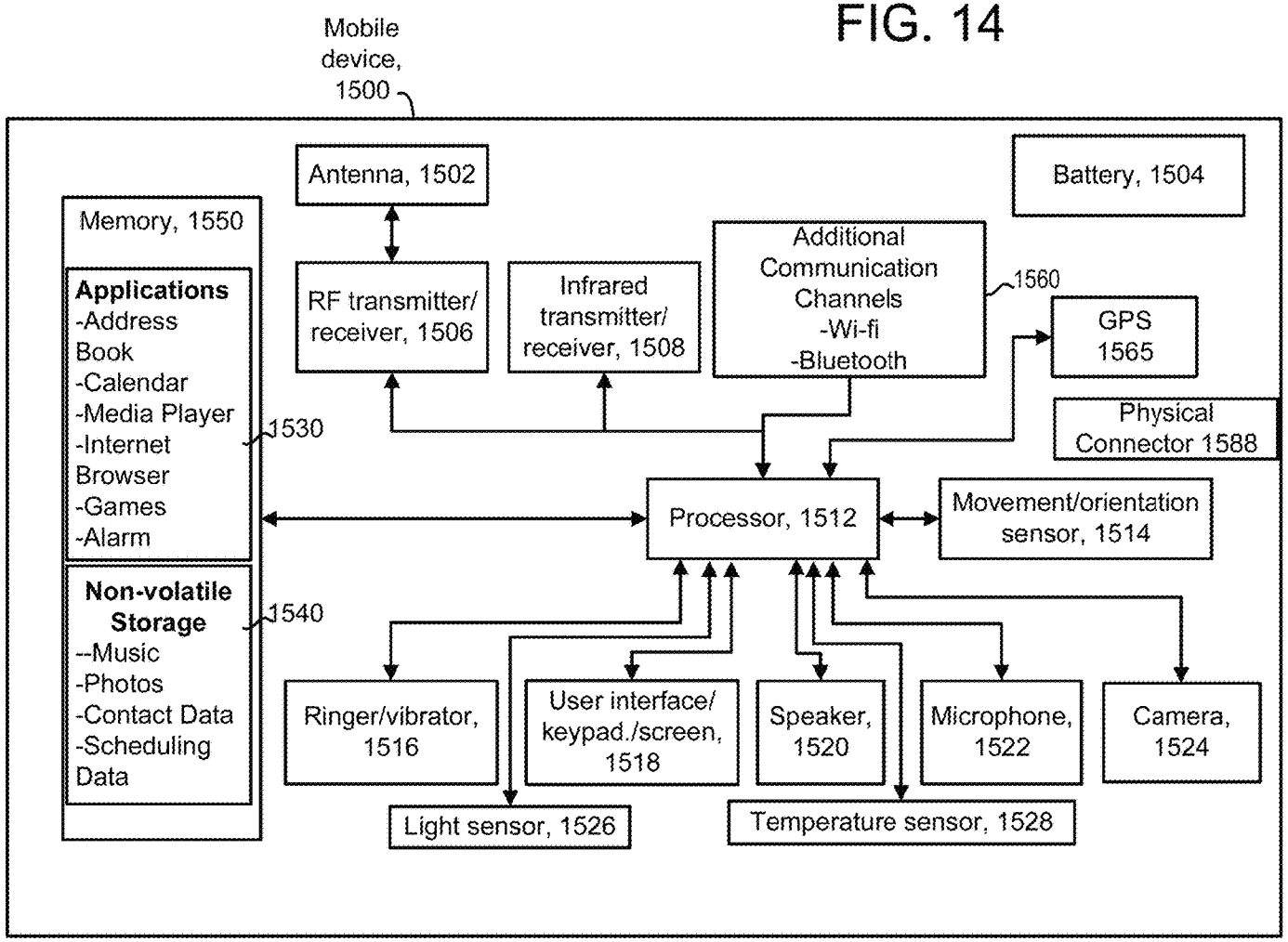
FIG. 14 is a block diagram of an exemplary processing device.
Figure 15:
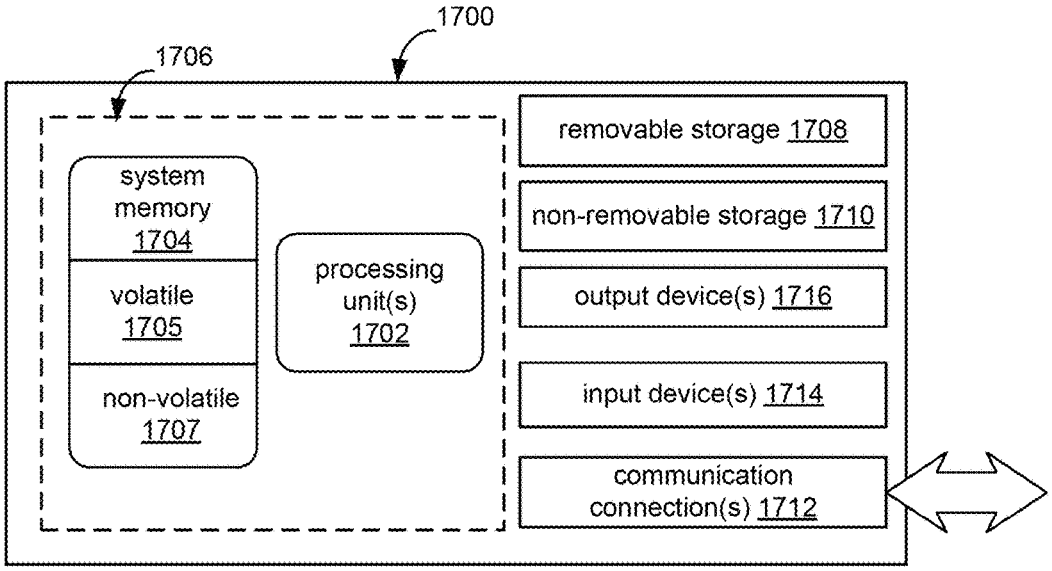
FIG. 15 is a block diagram of another exemplary processing device.

Each of the processing environments, servers and or computers illustrated herein may be implemented by one or more of the processing devices illustrated in FIGS. 14-16.

FIG. 15 is a block diagram of an exemplary mobile device which may operate in embodiments of the technology described herein (e.g. processing unit 4). Exemplary electronic circuitry of a typical mobile phone is depicted. The device 1500 includes one or more microprocessors 1512, and memory 1510 (e.g., non-volatile memory such as ROM and volatile memory such as RAM) which stores processor-readable code which is executed by one or more processors of the control processor 1512 to implement the functionality described herein.

Mobile device 1500 may include, for example, processors 1512, memory 1550 including applications and non-volatile storage. The processor 1512 can implement communications, as well as any number of applications, including the interaction applications discussed herein. Memory 1550 can be any variety of memory storage media types, including non-volatile and volatile memory. A device operating system handles the different operations of the mobile device 1500 and may contain user interfaces for operations, such as placing and receiving phone calls, text messaging, checking voicemail, and the like. The applications 1530 can be any assortment of programs, such as a camera application for photos and/or videos, an address book, a calendar application, a media player, an Internet browser, games, other multimedia applications, an alarm application, other third party applications, the interaction application discussed herein, and the like. The non-volatile storage component 1540 in memory 1510 contains data such as web caches, music, photos, contact data, scheduling data, and other files.

The processor 1512 also communicates with RF transmit/receive circuitry 1506 which in turn is coupled to an antenna 1502, with an infrared transmitted/receiver 1508, with any additional communication channels 1560 like Wi-Fi or Bluetooth, and with a movement/orientation sensor 1514 such as an accelerometer. Accelerometers have been incorporated into mobile devices to enable such applications as intelligent user interfaces that let users input commands through gestures, indoor GPS functionality which calculates the movement and direction of the device after contact is broken with a GPS satellite, and to detect the orientation of the device and automatically change the display from portrait to landscape when the phone is rotated. An accelerometer can be provided, e.g., by a micro-electromechanical system (MEMS) which is a tiny mechanical device (of micrometer dimensions) built onto a semiconductor chip. Acceleration direction, as well as orientation, vibration and shock can be sensed. The processor 1512 further communicates with a ringer/vibrator 1516, a user interface keypad/screen, biometric sensor system 1518, a speaker 1520, a microphone 1522, a camera 1524, a light sensor 1526 and a temperature sensor 1528.

The processor 1512 controls transmission and reception of wireless signals. During a transmission mode, the processor 1512 provides a voice signal from microphone 1522, or other data signal, to the RF transmit/receive circuitry 1506. The transmit/receive circuitry 1506 transmits the signal to a remote station (e.g., a fixed station, operator, other cellular phones, etc.) for communication through the antenna 1502. The ringer/vibrator 1516 is used to signal an incoming call, text message, calendar reminder, alarm clock reminder, or other notification to the user. During a receiving mode, the transmit/receive circuitry 1506 receives a voice or other data signal from a remote station through the antenna 1502. A received voice signal is provided to the speaker 1520 while other received data signals are also processed appropriately.

Additionally, a physical connector 1588 can be used to connect the mobile device 1500 to an external power source, such as an AC adapter or powered docking station. The physical connector 1588 can also be used as a data connection to a computing device. The data connection allows for operations such as synchronizing mobile device data with the computing data on another device.

A GPS transceiver 1565 utilizing satellite-based radio navigation to relay the position of the user applications is enabled for such service.

The example computer systems illustrated in the Figures include examples of computer readable storage media. Computer readable storage media are also processor readable storage media. Such media may include volatile and non-volatile, removable and non-removable media implemented in any method or technology for storage of information such as computer readable instructions, data structures, program modules or other data. Computer storage media includes, but is not limited to, RAM, ROM, EEPROM, cache, flash memory or other memory technology, CD-ROM, digital versatile disks (DVD) or other optical disk storage, memory sticks or cards, magnetic cassettes, magnetic tape, a media drive, a hard disk, magnetic disk storage or other magnetic storage devices, or any other medium which can be used to store the desired information and which can accessed by a computer.

FIG. 16 is a block diagram of one embodiment of a computing system that can be used to implement a network accessible computing system or a companion processing module. FIG. 17 is a block diagram of one embodiment of a computing system that can be used to implement one or more network accessible computing systems 12 or a processing unit 4 which may host at least some of the software components of computing environment depicted in FIG. 12. With reference to FIG. 16, an exemplary system includes a computing device, such as computing device 1700. In its most basic configuration, computing device 1700 typically includes one or more processing units 1702 including one or more central processing units (CPU) and one or more graphics processing units (GPU). Computing device 1700 also includes memory 1704. Depending on the exact configuration and type of computing device, memory 1704 may include volatile memory 1705 (such as RAM), non-volatile memory 1707 (such as ROM, flash memory, etc.) or some combination of the two. This most basic configuration is illustrated in FIG. 17 by dashed line 1706. Additionally, device 1700 may also have additional features/functionality. For example, device 1700 may also include additional storage (removable and/or non-removable) including, but not limited to, magnetic or optical disks or tape. Such additional storage is illustrated in FIG. 16 by removable storage 1708 and non-removable storage 1710.

Device 1700 may also contain communications connection(s) 1712 such as one or more network interfaces and transceivers that allow the device to communicate with other devices. Device 1700 may also have input device(s) 1714 such as keyboard, mouse, pen, voice input device, touch input device, etc. Output device(s) 1716 such as a display, speakers, printer, etc. may also be included. All these devices are well known in the art and are not discussed at length here.

The example computer systems illustrated in the figures include examples of computer readable storage devices. A computer readable storage device is also a processor readable storage device. Such devices may include volatile and nonvolatile, removable and non-removable memory devices implemented in any method or technology for storage of information such as computer readable instructions, data structures, program modules or other data. Some examples of processor or computer readable storage devices are RAM, ROM, EEPROM, cache, flash memory or other memory technology, CD-ROM, digital versatile disks (DVD) or other optical disk storage, memory sticks or cards, magnetic cassettes, magnetic tape, a media drive, a hard disk, magnetic disk storage or other magnetic storage devices, or any other device which can be used to store the desired information and which can be accessed by a computer In one embodiment, the mixed reality display system 10 can be head mounted display device 2 (or other AN apparatus) in communication with a local processing apparatus (e.g., processing unit 4 of FIG. 1A, or other suitable data processing device). One or more networks 50 can include wired and/or wireless networks, such as a LAN, WAN, WiFi, the Internet, an Intranet, cellular network etc. No specific type of network or communication means is required. In one embodiment, mixed reality object handling service 1270 is implemented in a server coupled to a communication network, but can also be implemented in other types of computing devices (e.g., desktop computers, laptop computers, servers, mobile computing devices, tablet computers, mobile telephones, etc.). Mixed reality object handling service 1270 can be implemented as one computing device or multiple computing devices. In one embodiment, service 1270 is located locally on system 10.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method presenting a mixed reality environment allowing viewing of real world objects integrated with virtual objects by a user, comprising:

determining one or more real objects viewable by the user within a user environment;

determining one or more three-dimensional virtual objects adapted to be rendered to the user and viewable in conjunction with the one or more real objects within the user environment;

rendering the one or more virtual objects within a user field of view within the environment;

mapping a real object of the one or more real objects and a three-dimensional virtual object of the one or more three-dimensional virtual objects to respective object instances, the three-dimensional virtual object and the real object in the object instances defined using the same object definition including the same object definition of a physical attribute of the one or more real objects and the one or more three-dimensional virtual objects; and managing interaction between the three-dimensional virtual object and the real object based on the physical attribute defined in the respective object instances upon interaction of the three-dimensional virtual object and the real object.

2. The method of claim 1 wherein said rendering of the one or more virtual objects is based on at least one relational attribute in the same object definition defining a behavior of the one or more virtual objects relative to the one or more real objects.

3. The method of claim 1 wherein the step of managing interaction comprises:

tracking the real object and the virtual object within the user environment;

determining a virtual-real object interaction when the virtual object interacts with the real object; and rendering the virtual-real object interaction based on the set of attributes for a virtual object instance and the attributes of a real object instance.

4. The method of claim 1 further including:

tracking each of the one or more real objects and each of the one or more virtual objects within the user environment;

determining a virtual-virtual object interaction when a virtual object interacts with another virtual object;

rendering the virtual-virtual object interaction based on a user filter;

determining a virtual-real object interaction when a virtual object interacts with a real object; and rendering the virtual-real object interaction based on the set of attributes for a virtual object instance and the attributes of a real object instance.

5. The method of claim 1 wherein the set of attributes includes one or more functions for the virtual object.

6. The method of claim 1 further including generating the object instances and sharing object instances with other users via a communication link, and receiving shared object instances from other users, and including rendering and managing the interaction between the object instances shared by other users and generated object instances.

7. A see through head mounted display apparatus, comprising:

a see-through, near-eye, augmented reality display adapted to render three-dimensional virtual objects to the user in the display which are viewable in conjunction with real objects;

one or more processing devices in wireless communication with apparatus, the one or more processing devices automatically determine an environment, one or more real objects in the environment and one or more three-dimensional virtual objects in the environment, the one or more processing devices assign an object instance to each of the real and three-dimensional virtual objects in the environment, each three-dimensional virtual object and each real object in each object instance defined having an object definition representing a physical trait of the one or more three-dimensional virtual objects and the one or more real objects and provided in a data structure containing a common set of attributes for the real and three-dimensional virtual objects such that each three-dimensional virtual object and each real object share the same attributes, the one or more processing devices determine input data from real world objects and three-dimensional virtual objects in a field of view and integrate interaction between real and three-dimensional virtual objects based on the object instances; wherein said interaction of the one or more three-dimensional virtual objects with one or more real objects is based on at least one relational attribute in the common set of attributes defining the behavior of the three-dimensional virtual object relative to the one or more real objects.

8. The apparatus of claim 7 wherein the common set of attributes comprises a data structure including includes at least one attribute of:

object type, spatial coordinates, object registration, reality rating, dynamic scaling, ownership, user permissions, content rating, physical properties, learned attributes, related objects and functions.

9. The apparatus of claim 8 wherein the physical properties include at least physics attributes defining object movement and actions and an interaction rule set defining object interaction with other objects.

10. The apparatus of claim 8 wherein the object definition includes an identifier.

11. The apparatus of claim 10 wherein each instance of an object definition is specifically identified.

12. The apparatus of claim 8 wherein the apparatus includes a memory and a data structure, the data structure including one or more object definitions modified by a user and owned by a user.

13. The apparatus of claim 12 wherein the one or more processors track each of the real objects and each of the virtual objects within a user environment;

determine a virtual-virtual object interaction when a virtual object interacts with another virtual object;

render the virtual-virtual object interaction based on a user filter;

determine a virtual-real object interaction when a virtual object interacts with another virtual object; and render the virtual-real object interaction based on the set of attributes for a virtual object instance and the attributes of a real object instance.

14. A method for managing interaction between virtual holographic objects and real world objects in a mixed reality environment generated by a see through head mounted display system, comprising:

determining an environment and orientation of the system, the system includes one or more sensors and a see-through display;

determining three-dimensional locations in three-dimensional space of real and virtual objects within an environment of a wearer of the see-through display in the environment;

creating an object instance for virtual objects and real objects within the environment, the virtual objects and the real objects in the object instances defined based on a common object definition comprising a set of attributes such that the virtual objects and the real objects share the same sub-set of core attributes, wherein the set of attributes of the common object definition relates to a common physical trait of three-dimensional virtual object and each real object;

determining whether an interaction between at least two objects occurs, the interaction being one of an interaction between a virtual object and another virtual object, or an interaction between a virtual object and a real world object, and the interaction comprising the at least two objects sharing at least one point in three-dimensional space;

rendering virtual objects to the display which are viewable in conjunction with the real objects where the interaction between the at least two objects in the display based on attributes defined in the object instance of any interacting virtual and real objects and a system filter, the system filter interpreting the attributes of each of the interacting objects according to user specified filter settings relative to rendering the interaction in the display and wherein said rendering of the one or more virtual objects is based on at least one relational attribute defining the behavior of the virtual object relative to the one or more real objects.

15. The method of claim 14 wherein each object instance contains a value for at least one attribute of: object type, spatial coordinates, object registration, reality rating, dynamic scaling, ownership, user permissions, content rating, physical properties, learned attributes, related objects and functions, and the interaction between the at least two objects is based on an the value in each said attribute.

16. The method of claim 15 wherein the at least one relational attribute defines a relation of the object to a user, an environment or another object.

17. The method of claim 16 wherein the attribute of spatial coordinates defines the position of an object relative to a relational attribute value.

18. The method of claim 15 further including accessing generic object libraries provided by a mixed reality service, the generic object libraries containing generic object definitions accessible by an object identifier, the generic object definitions used to create object instances.

19. The method of claim 18 further including providing user-specific object definitions accessible by an object identifier to a mixed reality service, the user-specific object definitions used to create object instances by a creating user and a shared user.

* * * * *